US010315893B2

(12) United States Patent
Zimmer et al.

(10) Patent No.: US 10,315,893 B2
(45) Date of Patent: Jun. 11, 2019

(54) LATTICE MAST ELEMENT, LATTICE BOOM COMPRISING AT LEAST ONE LATTICE MAST ELEMENT OF THIS TYPE AND CRANE COMPRISING AT LEAST ONE LATTICE BOOM OF THIS TYPE

(71) Applicant: TEREX GLOBAL GMBH, Schaffhausen (DE)

(72) Inventors: Walter Zimmer, Sulzbach (DE); Uli Anken, Kirkel-Limbach (DE); Fritz-Botho Köster, Rockenhausen (DE); Oliver Lapp, Zweibrücken (DE); Thorsten Helwes, Homburg (DE)

(73) Assignee: TEREX GLOBAL GMBH, Schaffhausen (CH)

( * ) Notice: Subject to any disclaimer, the term of this patent is extended or adjusted under 35 U.S.C. 154(b) by 488 days.

(21) Appl. No.: 14/776,859

(22) PCT Filed: Mar. 18, 2014

(86) PCT No.: PCT/EP2014/055362
§ 371 (c)(1),
(2) Date: Sep. 15, 2015

(87) PCT Pub. No.: WO2014/147047
PCT Pub. Date: Sep. 25, 2014

(65) Prior Publication Data

US 2016/0023868 A1 Jan. 28, 2016

(30) Foreign Application Priority Data

Mar. 22, 2013 (DE) ..... 10 2013 205 173

(51) Int. Cl.
*B66C 23/64* (2006.01)
*B66C 23/70* (2006.01)
*B66C 23/06* (2006.01)

(52) U.S. Cl.
CPC ..... *B66C 23/64* (2013.01); *B66C 23/06* (2013.01); *B66C 23/70* (2013.01)

(58) Field of Classification Search
CPC ..... B66C 23/00; B66C 23/06; B66C 23/26; B66C 23/365; B66C 23/62; B66C 23/64;
(Continued)

(56) References Cited

U.S. PATENT DOCUMENTS 1,105,776 A * 8/1914 Haskell ..... E04H 12/10 52/651.04
1,105,777 A * 8/1914 Haskell ..... E04H 12/10 52/651.03

(Continued)

FOREIGN PATENT DOCUMENTS

CN 102372233 A 3/2012
DE 102006060347 A1 6/2008

(Continued)

*Primary Examiner* — Michael R Mansen
*Assistant Examiner* — Juan J Campos, Jr.
(74) *Attorney, Agent, or Firm* — Browdy and Neimark, PLLC

(57) ABSTRACT

A lattice mast element for a crane comprises at least two longitudinal elements and at least one transverse element interconnecting the longitudinal elements and at least one bracing element for bracing the lattice mast element by interconnecting the longitudinal elements and/or the transverse element, wherein the longitudinal elements and the transverse element define a load bearing surface of the lattice mast element and the longitudinal elements are each configured as a two-dimensional load bearing structure.

17 Claims, 29 Drawing Sheets

(58) Field of Classification Search
CPC ..... B66C 23/70; E04H 12/10; E04H 12/187; Y10T 29/49625; Y10T 29/49634; B21D 47/01
USPC ..... 52/646, 648.1, 650.1, 650.2, 651.01, 52/651.07
See application file for complete search history.

(56) References Cited

U.S. PATENT DOCUMENTS

| | | | | |
|---|---|---|---|---|
| 3,407,559 | A * | 10/1968 | Durand | B66C 23/286 52/637 |
| 2002/0053550 | A1 | 5/2002 | Stoof | |
| 2008/0173605 | A1 | 7/2008 | Willim | |
| 2009/0261053 | A1* | 10/2009 | Bohnacker | B66C 23/60 212/300 |
| 2011/0308189 | A1 | 12/2011 | Daas et al. | |
| 2012/0031868 | A1* | 2/2012 | Willim | B66C 23/70 212/299 |
| 2012/0045345 | A1* | 2/2012 | Horton, III | E04H 12/10 416/244 R |
| 2012/0110946 | A1* | 5/2012 | Daas | B66C 23/70 52/646 |
| 2013/0168522 | A1* | 7/2013 | Daas | B66C 23/70 248/354.1 |
| 2013/0334159 | A1* | 12/2013 | Daas | B66C 23/70 212/299 |

FOREIGN PATENT DOCUMENTS

| | | | |
|---|---|---|---|
| DE | 202010011131 | U1 | 11/2011 |
| DE | 102011108236 | A1 | 2/2012 |
| DE | 202011002901 | U1 | 5/2012 |
| EP | 0609998 | A1 | 8/1994 |
| EP | 1935833 | A | 6/2008 |
| EP | 2253575 | A1 | 11/2010 |
| JP | 2007-302433 | A | 11/2007 |
| JP | 2011-527388 | A | 10/2011 |
| NL | 1031331 | C1 | 9/2007 |
| NL | 1035078 | C1 | 3/2008 |
| WO | 2009131442 | A1 | 10/2009 |

* cited by examiner

LATTICE MAST ELEMENT, LATTICE BOOM COMPRISING AT LEAST ONE LATTICE MAST ELEMENT OF THIS TYPE AND CRANE COMPRISING AT LEAST ONE LATTICE BOOM OF THIS TYPE

CROSS-REFERENCE TO RELATED APPLICATIONS

This application claims the priority of German Patent Application, Serial No. DE 10 2013 205 173.5, filed on Mar. 18, 2013, pursuant to 35 U.S.C. 119(a)-(d), the content of which is incorporated herein by reference in its entirety as if fully set forth herein.

FIELD OF THE INVENTION

The invention relates to a lattice mast element, a lattice boom comprising at least one lattice mast element of this type and crane comprising at least one lattice boom of this type.

Lattice mast cranes have been known from prior art for a long time. A cross-sectional area of a lattice boom can be increased to ensure increasing load bearing capacities. An excess cross-sectional area of a lattice boom having a width of more than 4 m and a height of more than 3 m, for example, leads to problems in the transport of the lattice boom.

BACKGROUND OF THE INVENTION

EP 2 253 575 A1 discloses a backstay spreader for a crane. A foldable spreader is used to spread a double-strap backstay section for a lifting crane.

EP 0 609 998 A1 discloses a longitudinally divided lattice mast crane which allows the lattice mast to be separated in a symmetry plane in such a way that the lattice mast is transportable with a reduced height.

DE 10 2011 108 236 A1 discloses a lattice section for a crane in which four corner posts interconnected by means of a plurality null bars and diagonal bars, the diagonal bars being actuable in such a way that the height of the lattice section is variable between a working arrangement and a transport arrangement.

US 2012/0110946 A1 discloses a lattice boom which is foldable both along its width and along its height. A lattice boom of this type has a very complex folding mechanism.

US 2002/0053550 A1 discloses a lattice mast element in the form of a connectable framework structure. Frames can be produced from bars and connection elements, the frames being oriented perpendicular to the longitudinal direction of the lattice mast element. A lattice mast element of this type has a reduced stiffness.

DE 10 2006 060 347 B4 discloses a lattice section for a large mobile crane. The lattice section comprises corner posts, null bars and diagonal bars.

NL 1 035 078 C discloses a dividable, longitudinally divided lattice mast element which can be divided for a transport arrangement and transported separately from each other.

NL 1 031 331 C discloses a lattice mast crane comprising two lattice booms. One of the lattice booms has an increased lattice mast element width in a central region.

SUMMARY OF THE INVENTION

An object of the present invention is to further develop a lattice mast element for a lattice mast in such a way as to have high load bearing capacity on the one hand while being easily transportable on the other, the lattice mast element having an increased stiffness in particular in a predefinable direction although less material is required.

This object is achieved according to the invention by a lattice mast element for a crane, comprising at least two longitudinal elements, a transverse element interconnecting the longitudinal elements, and at least one bracing element for bracing the lattice mast element by interconnecting the longitudinal elements and/or the transverse element, wherein the longitudinal elements and the transverse element define a load bearing surface of the lattice mast element, and the longitudinal elements are each configured as a two-dimensional load bearing structure.

According to the invention, it was found that a lattice mast element having at least two longitudinal elements and a transverse element interconnecting the longitudinal elements obtains a particularly high lateral stiffness, in other words in a transverse direction defined by the transverse element, due to the fact that the longitudinal elements, which are each configured as a two-dimensional load bearing structure, are arranged at a distance from each other. The longitudinal elements and the transverse element form a frame for the lattice mast element. The longitudinal elements are side walls, arranged opposite to each other, of the frame. The transverse element forms an intermediate wall disposed between the side walls. If only one transverse element is provided, the frame is open towards at least one side that is opposite to the transverse element. It is conceivable as well to use more than one transverse element. In this case, it is possible to form a closed frame for the lattice mast element. The frame formed by the longitudinal elements and the transverse element defines a load bearing surface. The load bearing surface is arranged parallel to the lattice mast longitudinal axis. The frame-like side wall formed by the respective longitudinal elements and the frame-like intermediate wall formed by the transverse element define the frame. The intermediate wall has a transverse surface oriented perpendicular to the lattice mast element longitudinal axis. In particular, this allows a plurality of lattice mast elements according to the invention to be arranged one behind the other along the lattice mast longitudinal axis. In other words, the frame-like lattice mast elements are in particular arrangeable in such a way that the individual load bearing surfaces of the lattice mast elements define a common, plane load bearing surface. In particular, the load bearing surfaces are not arranged at a distance from each other along the lattice mast longitudinal axis. The lattice mast elements according to the invention and the lattice mast according to the invention differ from the former prior-art approach to arrange hollow-profile lattice mast elements one behind the other along the lattice mast longitudinal axis. Compared to the hollow profile configuration, a profile element longitudinal axis of the lattice mast elements according to the invention is oriented perpendicular to the lattice mast longitudinal axis.

The longitudinal elements are in particular configured in one piece, in other words they are not dividable. The longitudinal elements may also be configured in multiple pieces, in particular such as to be interconnectable by plugging. In particular, individual components of the longitudinal elements may be interconnected detachably, in particular using bolts. The longitudinal elements are in particular plane. The longitudinal elements are substantially arranged along a lattice mast element longitudinal axis and are in particular configured identically. The lattice mast element longitudinal axis is parallel to the x-axis of a Cartesian coordinate system. It is conceivable as well to provide a plurality of transverse elements, in other words in particular at least two transverse elements. The function of the transverse elements is in particular to interconnect the longitudinal elements in a detachable or articulated manner. The transverse elements are oriented transversely and in particular perpendicular to the lattice mast element longitudinal axis. The transverse elements are parallel to a y-axis of the Cartesian coordinate system and oriented in particular in a plane parallel to the yz-plane. The lattice mast element according to the invention has a modular configuration in the form of a three-dimensional load bearing structure having a comparatively high stiffness, the load bearing structure comprising a plurality of, in particular at least two, two-dimensional load bearing structures in the form of the longitudinal elements. The longitudinal elements and the transverse elements define a load bearing surface of the lattice mast element. The load bearing surface is parallel to the xz-plane of the Cartesian coordinate system. The two-dimensional load bearing structures are in particular perpendicular to the load bearing surface, in other words they are parallel to the z-axis of the Cartesian coordinate system. Because the longitudinal elements are configured as two-dimensional load bearing structures themselves, they have a comparatively high intrinsic stiffness in their plane, in other words the xy-plane. Using the transverse elements, the three-dimensional load bearing structure of the lattice mast element is braced additionally, in particular in the yz-plane. At the same time, less material is required to produce the lattice mast element since only few weight-reduced transverse elements are used between the longitudinal elements. The lattice mast element according to the invention has an increased stiffness although less material is used. The lattice mast element has a low specific weight in relation to the stiffness of the cross-section. The in particular detachable and/or articulated connection of the longitudinal elements using the transverse elements allows the lattice mast element to be converted from a working arrangement having a maximum load bearing surface with a maximum lattice mast element width into a transport arrangement having a minimum load bearing surface with a minimum lattice mast element width. In the case of a maximum load bearing surface, the longitudinal elements have a maximum distance from each other along the y-axis. This ensures a particularly high stiffness of the lattice element along the y-direction. A lattice mast element of this type can for example be used for a lattice boom of an assembly crane. A lattice mast element of this type is adapted to absorb particularly high lateral forces, in particular along the y-axis. The minimum load bearing surface ensures a particularly advantageous, space-saving transportation of the lattice mast element in the transport arrangement. In the transport arrangement, the lattice mast element according to the invention is in particular transportable in a transport unit on roads, on rails and on waterways. In particular, permissible transport dimensions such as a maximum transport width of 3 m and a transport height of 4 m are not exceeded.

The lattice mast element has at least one bracing element for bracing the lattice mast element by interconnecting the longitudinal elements and/or the transverse element. As a result, the lattice mast element is braced additionally. In order to brace the lattice mast element, at least one bracing element is used which is in particular provided in an articulated and/or detachable manner to connect the longitudinal elements and/or the transverse elements. The at least one bracing element interconnects one longitudinal element with the transverse element to brace a corner region between the longitudinal element and the transverse element. Generally, it is conceivable as well that the at least one bracing element interconnects two longitudinal elements. The bracing element is arranged within the load bearing surface and/or in an edge region of the load bearing surface. If more than one bracing elements are provided, they may be arranged in two bracing element planes arranged at a distance from each other. The bracing element planes are arranged at a distance from each other in particular along a height, in other words along a z-axis. The bracing element plane is identical to the load bearing surface or is oriented at an angle of inclination thereto. In a lattice mast element, the longitudinal elements may follow a conical path along the lattice mast element longitudinal axis. The longitudinal elements themselves are, in other words, configured in the shape of a trapezoid. The trapezoidal shape of the longitudinal elements defines an angle of inclination. The load bearing surface, in other words the bracing element plane, is arranged at said angle of inclination relative to a respective projection surface oriented parallel to the lattice mast longitudinal axis. If the angle of inclination exceeds a maximum angle of inclination, the bracing elements are preferably oriented within the load bearing surface.

The bracing elements are not parallel to the lattice mast longitudinal axis. The maximum angle of inclination is for instance 5°, in particular at most 4°, in particular at most 3°, in particular at most 2°, in particular at most 1.5°. If the maximum angle of inclination is not exceeded, the bracing elements can be arranged parallel to the projection surface oriented parallel to the lattice mast longitudinal axis. In this case, the bracing element plane is not parallel to the load bearing surface. The bracing element plane and the load bearing surface are then arranged relative to each other at the angle of inclination mentioned above, said angle exceeding the maximum angle of inclination. In this case, the bracing elements are not parallel to the chord elements of the longitudinal elements. An arrangement of this type offers advantages in terms of the mechanical processing and production of a lattice mast element. The at least one bracing element is directly connected to the longitudinal elements and/or the transverse element A lattice mast element having a lattice mast element width greater than a lattice mast element height oriented perpendicular to the load bearing surface, wherein in particular $B>2\cdot H$, in particular $B>3\cdot H$, and in particular $B>4\cdot H$, has a particularly high transverse stiffness. A cross-sectional area of the lattice mast element oriented parallel to the yz-plane, which is in particular oriented perpendicular to the lattice mast element longitudinal axis, is in particular rectangular. The term "lattice mast element width" refers to a distance of the longitudinal elements from each other. The terms "lattice mast element height" and "lattice mast element width" are used independently of the orientation of the lattice boom mounted to a crane. They rather express the fact that the lattice mast element width is the width of the yz-cross sectional surface area and in particular the width of the load bearing surface. The lattice mast element height defines the height of the yz-cross-sectional area. In particular, the orientation of the lattice mast element height and lattice mast element width is independent of the orientation of a luffing axis about which a lattice boom may be articulated to a crane to allow for a luffing movement thereof.

A lattice mast element having a lattice mast element width adjustable between a minimum lattice mast element width and a maximum lattice mast element width by a variable arrangement of the longitudinal elements relative to each other allows the longitudinal elements to be variably arranged relative to each other to ensure a minimum lattice mast width of the lattice mast element in a transport arrangement and a maximum lattice mast width of the lattice mast element in a working arrangement. In particular, the transverse elements and/or bracing elements are detachable from the longitudinal elements to which they are connected in an in particular articulated manner to allow the remaining transverse elements and/or bracing elements articulated to the longitudinal elements to be pivoted. In other words, it is in particular conceivable for the lattice element to be foldable. The lattice mast element is in particular folded in such a way that the two longitudinal elements are moved towards each other to reduce the lattice mast element width, which is in particular maximal in the working arrangement, to a width, which is in particular minimal in a transport arrangement. Said folding process allows the lattice mast element to be rapidly and in particular easily converted from the working arrangement into the transport arrangement.

A lattice mast element having at least four bracing elements arranged parallel to the load bearing surface in an in particular rhombical shape within the in particular rectangular lattice mast element. The corners of the rhombus are each in particular arranged in the center of the sides of the lattice mast element. A lattice mast element of this type is braced in all directions in the xy-plane.

A lattice mast element in which the longitudinal elements are configured as a truss, a frame or a girder allows a particularly advantageous design of the longitudinal elements. When designed as a truss, the longitudinal elements may be provided with null bars and/or diagonal bars for bracing the truss. In the truss, tension bars and connection bars are interconnected. The tension bars and compression bars are for example configured as diagonal bars or upper and lower chord elements of the longitudinal elements. Alternatively, it is conceivable as well to design the longitudinal elements in the manner of a frame, in other words an assembly of bars having rigid corners, or in the manner of a girder, in other words as a single beam. In particular, the transverse elements and/or bracing elements may be configured as two-dimensional load bearing structures and in particular in the form of a truss comprising null bars and/or diagonal bars, as frames or as girders.

A lattice mast element in which the longitudinal elements and/or the transverse elements each have two chord elements arranged at a distance from each other along a height oriented parallel to the z-axis has an increased stiffness in a definable plane. The design of the chord elements themselves increases the stiffness of the longitudinal elements and the transverse elements in a direction perpendicular to a respective element plane, in other words the yz-plane or the xz-plane, respectively. The chord elements are in particular configured as hollow profile elements. The height is in particular perpendicular to the load bearing surface. The chord elements have an axial geometrical moment of inertia about the z-axis that is greater than an axial geometrical moment of inertia about a transverse axis oriented perpendicular to the z-axis. In the longitudinal elements, the transverse axis corresponds to the y-axis. In the transverse elements, the transverse axis corresponds to the x-axis. In either case, the transverse axis is oriented perpendicular to a plane spanned by the longitudinal element or the transverse element.

A lattice mast element comprising at least two transverse elements which, in a working arrangement of the lattice mast element, are interconnected in a torque-proof manner, in other words they are not articulated to each other, about a z-axis oriented perpendicular to the load bearing surface and which, in a transport arrangement of the lattice mast element, are interconnected about a z-axis oriented perpendicular to the load bearing surface in an articulated manner ensures an improved conversion from the transport arrangement into the working arrangement and vice versa. Due to the fact that at least two interconnected transverse elements are provided to interconnect two longitudinal elements, the flexibility for moving the lattice mast element from the transport arrangement into the working arrangement is increased. Said additional flexibility for moving the lattice mast element is provided by the articulated connection of the transverse elements about the z-axis. The torque-proof connection of the transverse elements in the working arrangement is in particular achieved in that the transverse elements are interconnected by two, in particular parallel pivot axes arranged at a distance from each other. At least one of the pivot axes may be arranged outside a plane defined by a transverse element. This pivot axis has a distance from the transverse element in particular along the x-axis. Said spaced-apart arrangement of the pivot axis in relation to the transverse element may be provided by at least one articulating element, in particular two articulating elements arranged at a distance from each other along the pivot axis. As a result, the lattice mast element of this type has a sufficient stiffness in the working arrangement despite the articulated connection of the transverse element in the transport arrangement.

A lattice mast element comprising in each case one connection element interconnecting the transverse elements ensures an improved flexibility when moving the lattice mast element from the transport arrangement into the working arrangement. In particular the interconnection between the transverse elements is improved. Folding the transverse elements relative to each other is improved as well. In particular, a sagging of the bracing elements in the xy-plane is reduced when moving from the transport arrangement in the working arrangement and vice versa.

In particular if a plurality of lattice mast elements are arranged one behind the other along the lattice mast element longitudinal axis, a lattice mast element having a rectangular load bearing surface, in other words a rectangular cross-sectional area in the xy-plane, allows a lattice boom to be produced which has a constant cross-section along the lattice mast element longitudinal axis. A lattice mast element having a trapezoidal load bearing surface allows a conversion from a greater cross-sectional area to a smaller cross-sectional area in the yz-plane along the lattice mast element longitudinal axis or vice versa. A lattice mast element of this type increases the variability when designing a lattice boom.

In a lattice mast element comprising at least one drive element for the driven displacement of the lattice mast element from a working arrangement into a transport arrangement and vice versa, the conversion from the transport arrangement into the working arrangement and vice versa is facilitated. By means of a drive element, which is for instance a telescopable piston cylinder unit that is in particular driven hydraulically pneumatically or by means of an electric motor, the longitudinal elements, the transverse elements and/or the bracing elements are pivotable relative to each other. In particular when it comes to large-size cranes the longitudinal elements, transverse elements and bracing elements of which may have a large weight, thus making it difficult for a person to fold them manually, providing a drive element for assisting the displacement of the mentioned elements is advantageous.

A lattice mast element in which the longitudinal elements and in particular the transverse elements are each made of multiple parts and in particular comprise a plurality of individual components which are interconnectable detachably, in particular using bolts, allows the longitudinal elements to be disassembled completely. When all connections between the individual components are removed, the individual components can be transported in the form of bars. In particular, it is not necessary to transport two-dimensional load bearing structures. The stiffness of the two-dimensional load bearing structures is ensured by interconnecting the individual components using bolts.

Another object of the invention is to provide a lattice boom, in particular for a crane, that provides a sufficient load bearing capacity of the crane in the working arrangement while at the same time ensuring an uncomplicated transport of the lattice boom.

This object is achieved according to the invention by a lattice boom comprising at least one lattice mast element strand, a head element connected to the at least one lattice mast element strand, and a foot element connected to the at least one lattice mast element strand, wherein the at least one lattice mast element strand comprises at least one lattice mast element according to the invention.

It was found according to the invention that a lattice boom that is luffable in particular about a luffing axis oriented in particular horizontally has at least one lattice mast element strand comprising at least one lattice mast element. In particular, the lattice mast element strand comprises a plurality of lattice mast elements arranged one behind the other along the lattice mast element longitudinal axis. The individual lattice mast elements are interconnected detachably, in particular using bolts. Other detachable connections between the individual lattice mast elements are conceivable as well. What is most important in this respect is that the lattice mast elements, which are each in the shape of a rectangular profile, are arranged in such a way that the load bearing surfaces, defined by the respective rectangular profiles, of the individual lattice mast elements are arranged in a common plane. This means that the load bearing surfaces are arranged adjacent to each other along the lattice mast element longitudinal axis. If a lattice boom has precisely one lattice mast element strand, said lattice mast element strand is in particular arranged in such a way that the lattice mast element width is oriented parallel to the luffing axis. The lattice mast element longitudinal axis is parallel to the lattice mast longitudinal axis. The lattice mast element height is perpendicular to the luffing axis, in particular perpendicular to a plane spanned by the lattice mast element width and by the lattice mast element length. The lattice mast element height is equal to the lattice mast height. Via a foot element connected thereto, the lattice mast element strand is articulated to a crane, in particular to a superstructure of a crane, in an in particular luffable manner. A head element is provided at an end of the lattice mast element strand arranged opposite to the foot element. The advantages of the lattice boom substantially correspond to those of the lattice mast element to which reference is made. The foot element, the head element and the at least one lattice mast element arranged therebetween are in particular separable from each other for transporting the lattice boom. In particular, the mentioned elements are transported separately from each other.

A lattice boom comprising a plurality of lattice mast elements arranged one behind the other along a lattice boom longitudinal axis allows the length of the lattice boom to be set or adjusted along the lattice boom longitudinal axis to a required or desired length. The lattice boom longitudinal axis is parallel to the lattice mast element longitudinal axis.

Due to the two lattice mast element strands arranged parallel and/or at an angle relative to each other at least in sections, in particular at a distance from each other along a luffing axis, wherein the lattice mast elements are arranged in such a way that the lattice mast element strands have a lattice mast element strand height oriented perpendicular to a luffing axis at least in sections, said lattice mast element strand height being greater than a lattice mast element strand width oriented along the luffing axis, a lattice boom has an increased lateral stiffness and is in particular adapted to lift large loads. Compared to a lattice boom comprising only one single lattice mast element strand, the individual lattice mast elements of the lattice mast element strands in the lattice mast comprising two lattice mast element strands are rotated by 90° in relation to the lattice mast element longitudinal axis. This means that the lattice mast element width corresponds to a lattice mast element strand height. The lattice mast element height corresponds to the lattice mast element strand width. The lattice mast element strand height is identical to the lattice mast height. The lattice mast width is obtained from the respective lattice mast element strand width of the lattice mast element strands and a distance of the lattice mast element strands from each other in the direction of the luffing axis. It is possible that the lattice mast element strands are not arranged parallel to each other at least in sections. Correspondingly, the lattice mast width may be variable along the lattice mast longitudinal axis. The stiffness of a lattice boom in the z-direction, and therefore the load bearing capacity thereof may be limited due to maximum permissible transport dimensions. This transport problem can be solved by using a lattice mast element according to the invention for a lattice boom according to the invention. The lattice mast element is displaceable. This allows lattice mast element strands to be provided that have a lattice mast element strand height greater than a lattice mast element strand width. In particular, the lattice mast element strand height is a multiple of, in particular twice, in particular three times and in particular four times the lattice mast element strand width. In particular, the lattice mast element strands are detachable from each other.

Another object of the present invention is to provide a crane comprising a lattice boom, the lattice boom having an increased lateral stiffness while in particular being transportable in an uncomplicated manner.

This object is achieved according to the invention by a crane comprising at least one lattice boom according to the invention, the lattice boom being adapted to perform a luffing movement about a luffing axis.

It was found according to the invention that a crane comprising at least one lattice boom articulated about an in particular horizontal luffing axis in a luffable manner has an increased stiffness. A crane of this type is in particular an assembly crane, in particular for mounting a rotor to a wind power plant.

The resulting advantages for the crane substantially correspond to the advantages of the lattice mast element and the lattice boom to which reference is made.

Exemplary embodiments of the invention will hereinafter be explained in more detail with reference to the drawing.

DESCRIPTION OF THE PREFERRED EMBODIMENTS

Figure 1:
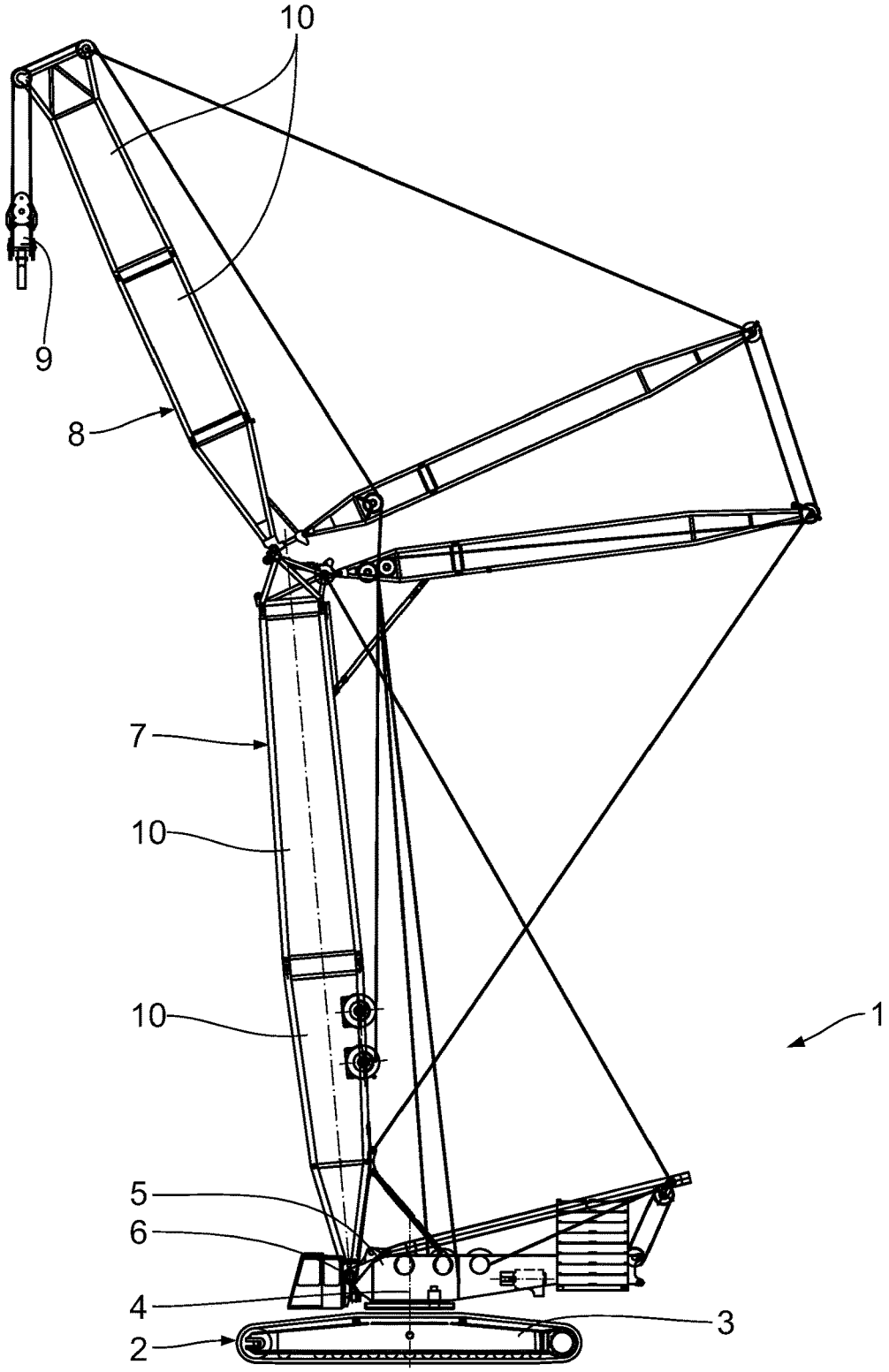
FIG. 1 shows a side view of a crawler crane comprising a lattice boom comprising a plurality of lattice mast elements.

A crane 1 shown in FIG. 1 is configured as a crawler crane comprising two crawler running gears 3 arranged parallel to each other on an undercarriage 2. The superstructure 5 is arranged on the undercarriage 2 in such a way as to be rotatable about a vertical axis of rotation 4. A lattice boom 7 is articulated to a horizontal luffing axis 6 in such a way as to allow a luffing movement in a vertical plane, which corresponds to the drawing plane in FIG. 1. At an end of the lattice boom 7 arranged opposite to the luffing axis 6, a jib 8 is articulated to the lattice boom 7 in a pivotable manner. The tip of the jib 8 is provided with a pulley 9 comprising a hook for the lifting, holding and displacing of loads. Both the lattice boom 7 and the jib 8 comprise a plurality of lattice mast elements 10.

Figure 2:
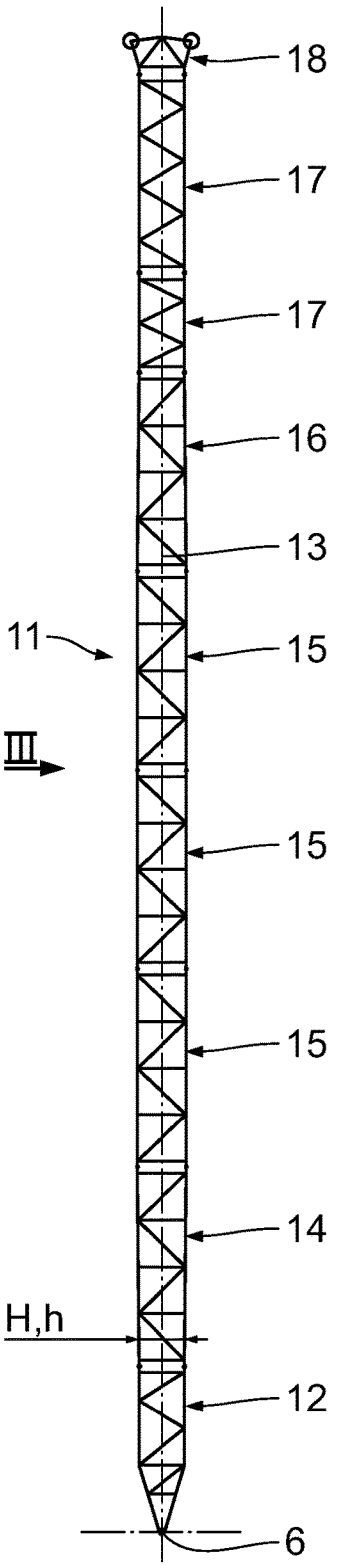
FIG. 2 shows a side view, corresponding to FIG. 1, of another lattice boom comprising a plurality of lattice mast elements according to the invention.
Figure 3:
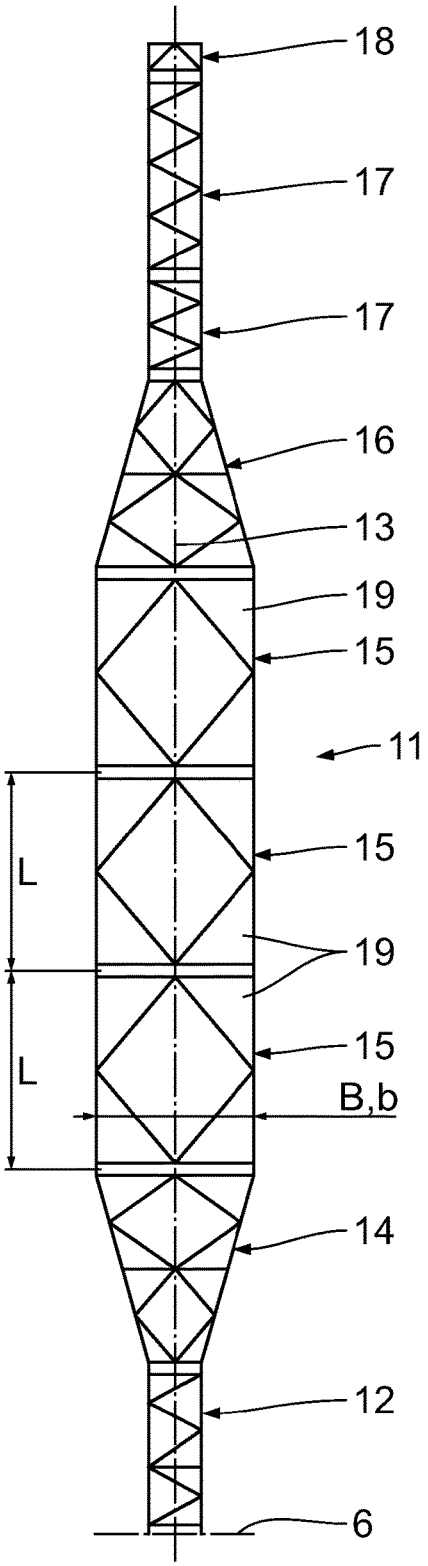
FIG. 3 shows a view of the lattice boom according to arrow III in FIG. 2.

FIGS. 2 and 3 show an embodiment of a lattice boom 11 according to the invention. The lattice boom 11 has a foot element 12 adapted to be articulated to the superstructure (not shown) of the crane in such a way as to allow a luffing movement about the luffing axis 6. The lattice boom 11 has a lattice boom longitudinal axis 13. Along the lattice boom longitudinal axis 13, the foot element 12 is adjoined by an adapter lattice mast element 14, a plurality of lattice mast elements 15, another adapter lattice mast element 16, additional lattice mast elements 17 and a head element 18.

The illustration in FIG. 2 shows that a lattice mast element height H is substantially unchanged along the lattice boom longitudinal axis 13. The lattice mast element height H is reduced only in a region of articulation of the foot element 12. The lattice mast element H is however substantially identical in particular for the adapter lattice mast elements 14, 16, for the lattice mast elements 15, 17 and for the head element 18. It is conceivable as well that the lattice mast element height H of the adapter lattice mast elements 14, 16 is variable along the lattice mast element longitudinal axis 13. In particular, it is conceivable that the lattice mast element height H increases from the foot element 12 towards the lattice mast element 15. Correspondingly, the lattice mast element height H may increase along the adapter lattice mast element 16 from the head element 18 or from the lattice mast element 17, respectively, towards the lattice mast element 15. The increase of the lattice mast element height H is in particular linear. The increase of the lattice mast element height H may also be non-linear in such a way as to in particular follow a curved path along the lattice mast element longitudinal axis 13. The lattice mast element height H is identical to a lattice mast height h oriented perpendicular to a plane spanned by the lattice mast longitudinal axis 13 and the luffing axis 6.

In contrast thereto, a lattice mast element width B, shown in FIG. 3, of the lattice mast elements 15 is considerably greater than a corresponding width of the foot element 12, the lattice mast elements 17 or the head element 18. In particular, the lattice mast element width B of the lattice mast element 15 is at least twice, in particular at least three times and in particular at least four times the width of the foot element 12, the lattice mast element 17 or the head element 18. The adapter lattice mast elements 14, 16 allow a transition from the width of the foot element 12 or the lattice mast element 17, respectively, to the increased lattice mast element width B of the lattice mast elements 15. The lattice mast element width B is identical to a lattice mast width b oriented parallel to the luffing axis 6.

In the illustrated lattice boom 11 according to the invention, the lattice mast element width B is parallel to the luffing axis 6 while the lattice mast element height H is perpendicular to the luffing axis 6. Both the lattice mast element width B and the lattice mast element height H are each perpendicular to the lattice boom longitudinal axis 13.

What is important is that the lattice boom 11 is considerably larger in the region of the lattice mast elements 15 along a direction, in this case a width parallel to the luffing axis 6, than in a direction, in this case a height, perpendicular thereto. As a result of the increased lattice mast element width B, which is in particular greater than twice the lattice mast element height H, in particular greater than three times the lattice mast element height H and in particular greater than four times the lattice mast element height H, the lattice mast element 15 has an increased lateral stiffness. A load bearing surface 19 is defined by the lattice mast element width B and by a lattice mast element length L oriented along the lattice mast longitudinal axis 13. The lattice mast element height H is oriented perpendicular to the load bearing surface 19, which is parallel to the xy-plane.

The lattice mast element 15 will hereinafter be explained in more detail with reference to FIG. 4 to FIG. 11. As shown by the diagrammatic illustration in FIGS. 4 and 5, the lattice mast element 15 comprises two longitudinal elements 21 arranged parallel to a lattice mast element longitudinal axis 20. The lattice mast element longitudinal axis 20 is parallel to an x-axis of a Cartesian coordinate system shown in FIG. 4. As shown in FIG. 6, the lattice mast element longitudinal axis 20 in particular coincides with the lattice boom longitudinal axis 13.

The longitudinal elements 21 are in each case interconnected at ends arranged opposite to each other along the lattice mast element longitudinal axis 20 by two interconnected transverse elements 22 oriented along the y-axis.

Both the longitudinal elements 21 and the transverse elements 22 spanning the rectangular load bearing surface 19 are each configured as two-dimensional load bearing structures. The two-dimensional load bearing structures 21, 22 are each oriented perpendicular to the load bearing surface 19. According to the Cartesian coordinate system in FIG. 4, the load bearing surface 19 is arranged in the xy-plane. Correspondingly, the longitudinal elements 21 are arranged in the xz-plane while the transverse elements 22 are arranged in the yz-plane. The x-direction corresponds to the longitudinal direction of the lattice mast element 15 or the lattice boom 11, respectively. The y-direction corresponds to the width of the lattice mast element 15. The z-direction corresponds to the height of the lattice mast element 15.

In order to interconnect the transverse elements 22, a respective connection element 23 is provided that is arranged therebetween. The connection elements 23 allow the transverse elements 22 to be interconnected in a torque-proof manner in the working arrangement of the lattice mast element 15 according to FIG. 4. This means that the transverse elements 22 are connected to the connection element 23 in such a way that they are unable to rotate about the z-axis. As a result, the lattice mast element has an increased stiffness. Via the connection elements 23, additional bracing elements 24 are connected to the longitudinal elements 21. Bracing elements 24 result in a substantially rhombical inner contour of the lattice mast element 15 and ensure an increased stiffness of the lattice mast element 15.

The bracing elements 24 are configured as two-dimensional load bearing structures as well.

The two-dimensional load bearing structures, in other words the longitudinal elements 21, the transverse elements 22, and the bracing elements 24, are in particular configured in one piece, in other words they are not dividable, and allow the total stiffness of the lattice mast element to be increased. The two-dimensional load bearing structures 21, 22, 24 are plane. In particular, the two-dimensional load bearing structures are each configured as a truss. It is conceivable as well for the two-dimensional load bearing structures to be configured as a frame or a girder.

Figure 4:
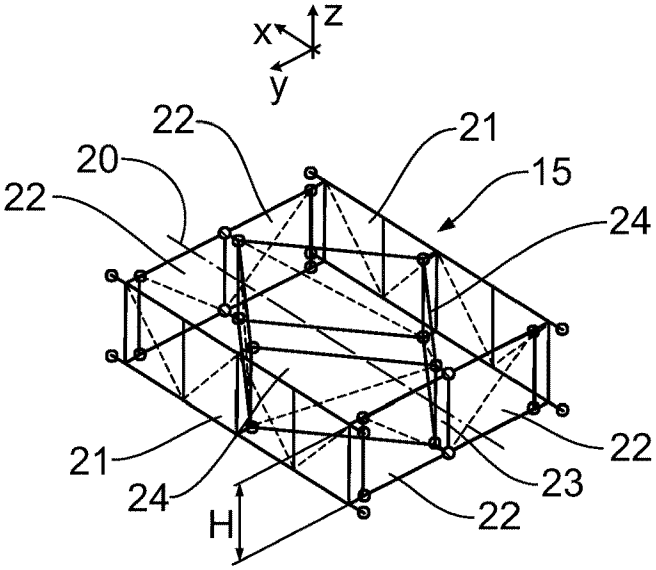
FIG. 4 shows a diagrammatic perspective view of a lattice mast element of the lattice boom in FIG. 2.
Figure 9:
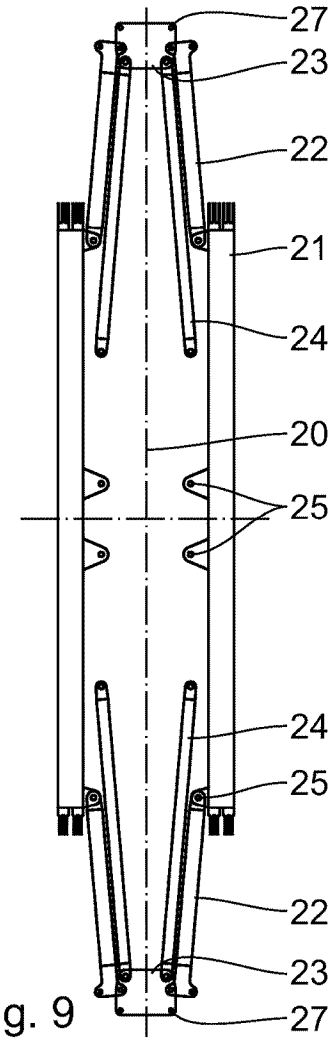
FIGS. 8 to 10 show various transport arrangements of the lattice mast element in FIG. 7.
Figure 8:
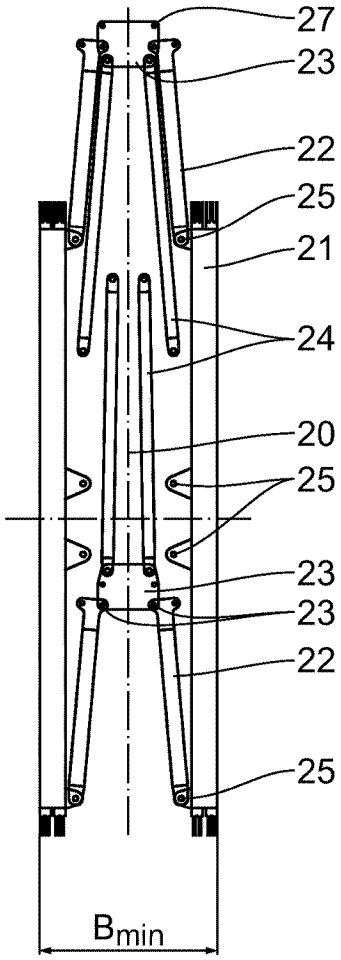
Figure 10:
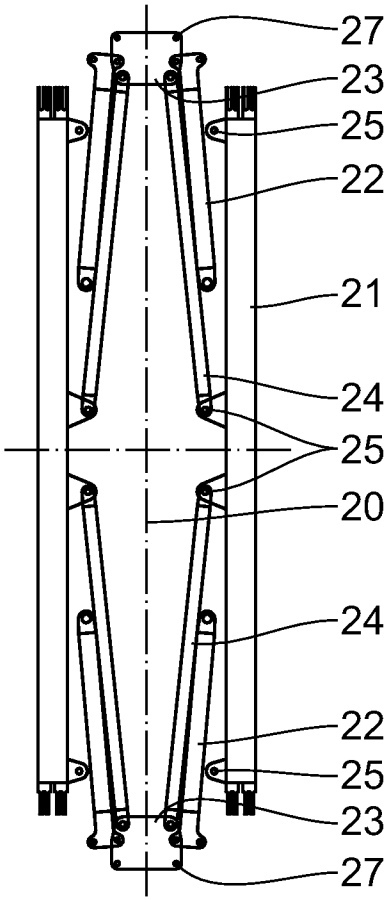

In order to ensure a particularly advantageous displacement of the lattice mast element 15 from the working arrangement shown in FIGS. 4 and 6 in which the lattice mast element has a maximum width $B_{max}$ into one of the transport arrangements shown in FIGS. 8 to 10 in which the lattice mast element 15 has in each case a respective minimum width $B_{min}$, the transverse elements 22 and the bracing elements 24 are each connected to the longitudinal elements 21 and/or the connection element 23 in an articulated and/or detachable manner. The bracing elements 24 are each articulated to the longitudinal element 21 in such a way as to be pivotable about a pivot axis 25 parallel to the z-axis and to the connection element 23 in such a way as to be pivotable about a pivot axis 26 parallel to the z-axis. The transverse elements 22 are interconnected in a torque-proof manner by two connection axes 27 oriented parallel to each other and to the z-axis. In particular, the connection axes 27 are oriented at a distance from each other along the lattice mast element longitudinal axis 20 and are in an off-center arrangement in relation to the lattice mast element 15, in other words they are arranged offset at a distance from the lattice mast longitudinal axis 20.

At an end arranged opposite to the connection element 23, the transverse elements 22 are pivotably connected to the longitudinal element 21 at a pivot axis 25 oriented parallel to the z-axis.

The conversion of the lattice mast element 15 from the working arrangement with the maximum lattice mast element width $B_{max}$ shown in FIG. 7 into the transport arrangement with a minimum lattice mast element width $B_{min}$ shown in FIG. 8 will be explained in the following sections. At the connection elements 23, a respective one of the connections of the transverse elements 22 to the connection axes 27 is removed in such a way that the respective transverse element 22 is connected to the connection element 23 in such a way as to be pivotable about the respective other connection axis 27. As a result, the torque-proof interconnection between the transverse elements 22 is released. The transverse elements 22 are pivotable relative to the connection element 23. At the same time, the bracing elements 24 are detached from the longitudinal elements 21 in the region of the pivot axes 25.

A preferred transport arrangement according to FIG. 8 is obtained in that the respective lower connection element 23 according to FIG. 8 is displaced upwards, in other words to a position between the two longitudinal elements 21. To this end, the bracing elements 24 are—in a first step—detached from the longitudinal elements 21 and pivoted about the pivot axes 26 in the direction of the lattice mast element longitudinal axis 20. Then the two transverse elements 22, which are originally arranged horizontally in the working arrangement, are pivoted substantially vertically upwards about the pivot axes 25. Correspondingly, in analogy to the lower connection element 23, the upper connection element 23 is pivoted upwards as well. In this folded transport arrangement, the transport width $B_{min}$ is reduced to an in particular transportable size. In particular, $B_{min}$ is at most 4 m and in particular at most 3 m. In the transport arrangement according to FIG. 8, the two connection elements 23 are displaced in the same direction, in other words upwards as shown in FIG. 8. In this arrangement, the lattice mast element 15 has a transport length greater than the length of the lattice mast element 15 in the working arrangement according to FIG. 7. Due to the fact that the pivot axes 25 along which the transverse elements 22 connected to the longitudinal elements 21 are pivoted have a comparatively large distance from each other along the lattice mast element longitudinal axis 20, the displacement from the working arrangement in FIG. 7 into the transport arrangement in FIG. 8 is particularly kinematically stable.

Figure 7:
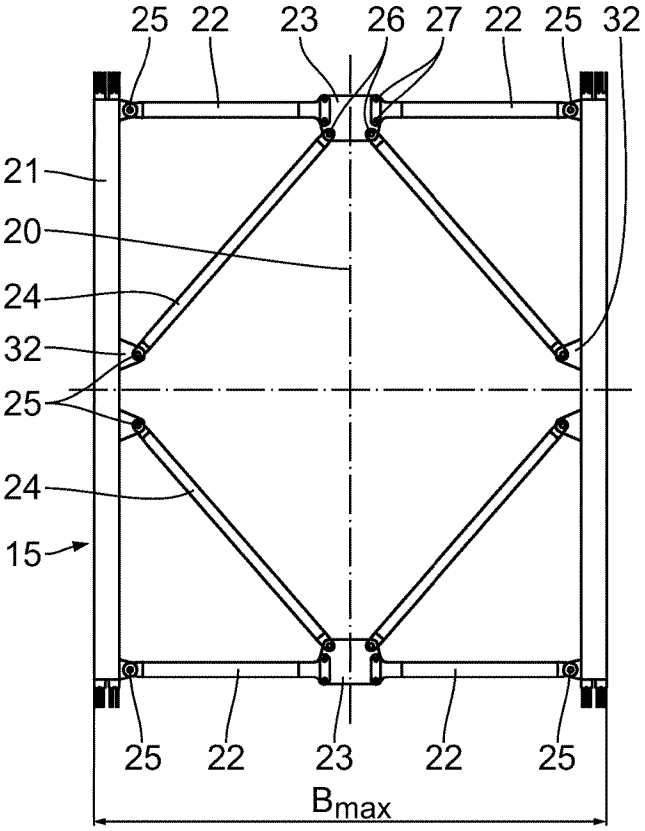
FIG. 7 shows a view, corresponding to FIG. 3, of an actual embodiment of the lattice mast element in a working arrangement.

It is possible as well to move the lattice mast element 15 shown in FIG. 7 into the transport arrangement shown in FIG. 9 by displacing the two connection elements 23 away from the lattice mast element center in opposite directions, in other words away from each other. In a transport arrangement of this type, the minimum lattice mast element width $B_{min}$ is identical to the minimum transport element width according to FIG. 8.

The smallest transport length for the lattice element 15 according to FIG. 7 is achievable by means of a transport arrangement according to FIG. 10. This transport arrangement is produced by detaching the pivot axes 25 between the transverse elements 22 and the longitudinal elements 21 and then in each case one of the connection axes 27 between the transverse elements 22 and the connection elements 23. The bracing elements 24 can now be used for pivoting the transverse elements 22 and the connection elements 23.

Figure 11:
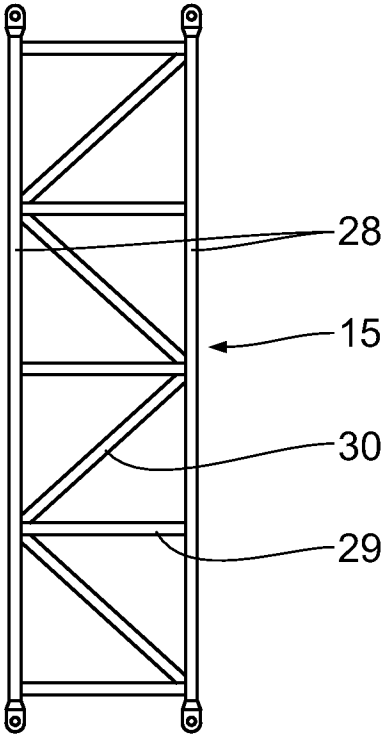
FIG. 11 shows a side view, corresponding to FIG. 2, of the lattice mast element in FIG. 7.

FIG. 11 shows a side view, corresponding to FIG. 2, of the lattice mast element 15. The drawing plane in FIG. 11 corresponds to the plane of the two-dimensional load bearing structure of the longitudinal element 21. The longitudinal element 21 has two chord elements 28 oriented parallel to each other which are interconnected by a plurality of null bars 29 and diagonal bars 30 so as to be additionally braced. The two-dimensional load bearing structure 21 of the lattice mast element 15 is configured as a truss.

Figure 12:
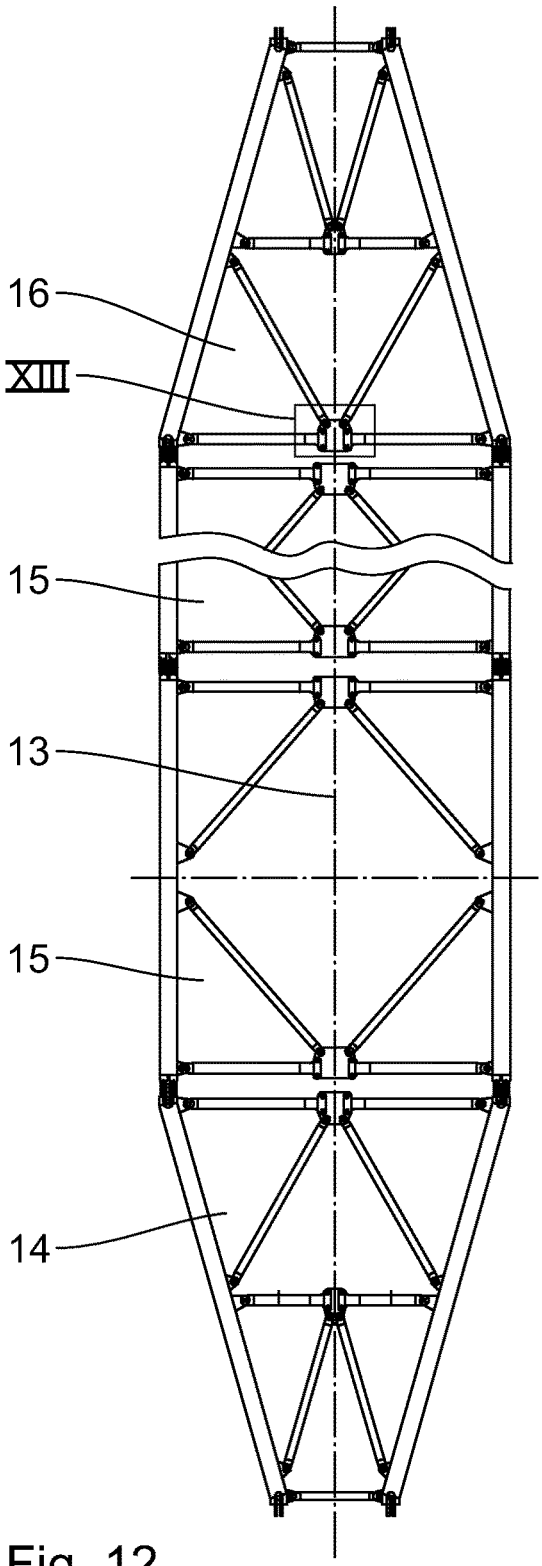
FIG. 12 shows a view, corresponding to FIG. 3, of the lattice boom in an actual embodiment.

FIG. 12 shows the lattice boom 11 according to FIG. 3 in an actual embodiment comprising the adapter lattice mast elements 14, 16 and the lattice mast elements 15 arranged therebetween.

Figure 13:
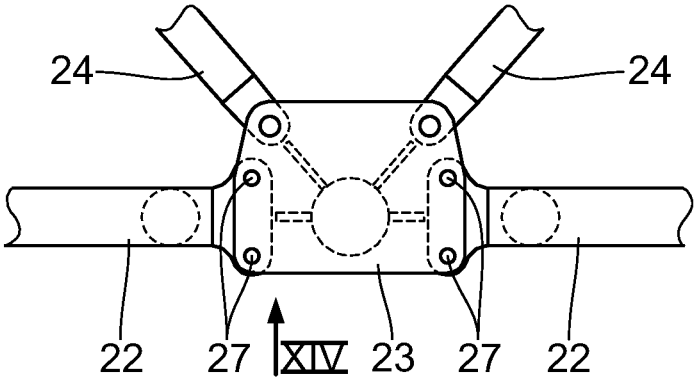
FIG. 13 shows an enlarged detail view of detail XIII in FIG. 12.
Figure 14:
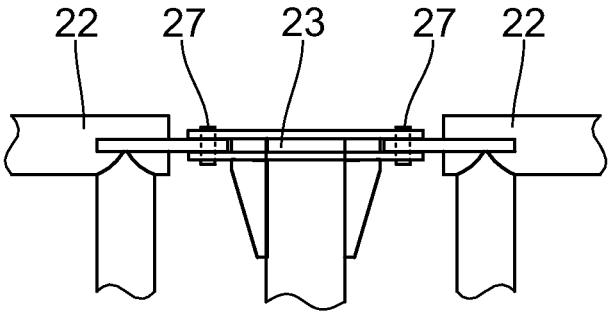
FIG. 14 shows a view according to arrow XIV in FIG. 13.

FIGS. 13 and 14 show a more detailed view of the connection element 23, which fulfils the same function in the adapter lattice mast elements 14, 16 as the connection elements 23 of the lattice mast elements 15.

Figure 15:
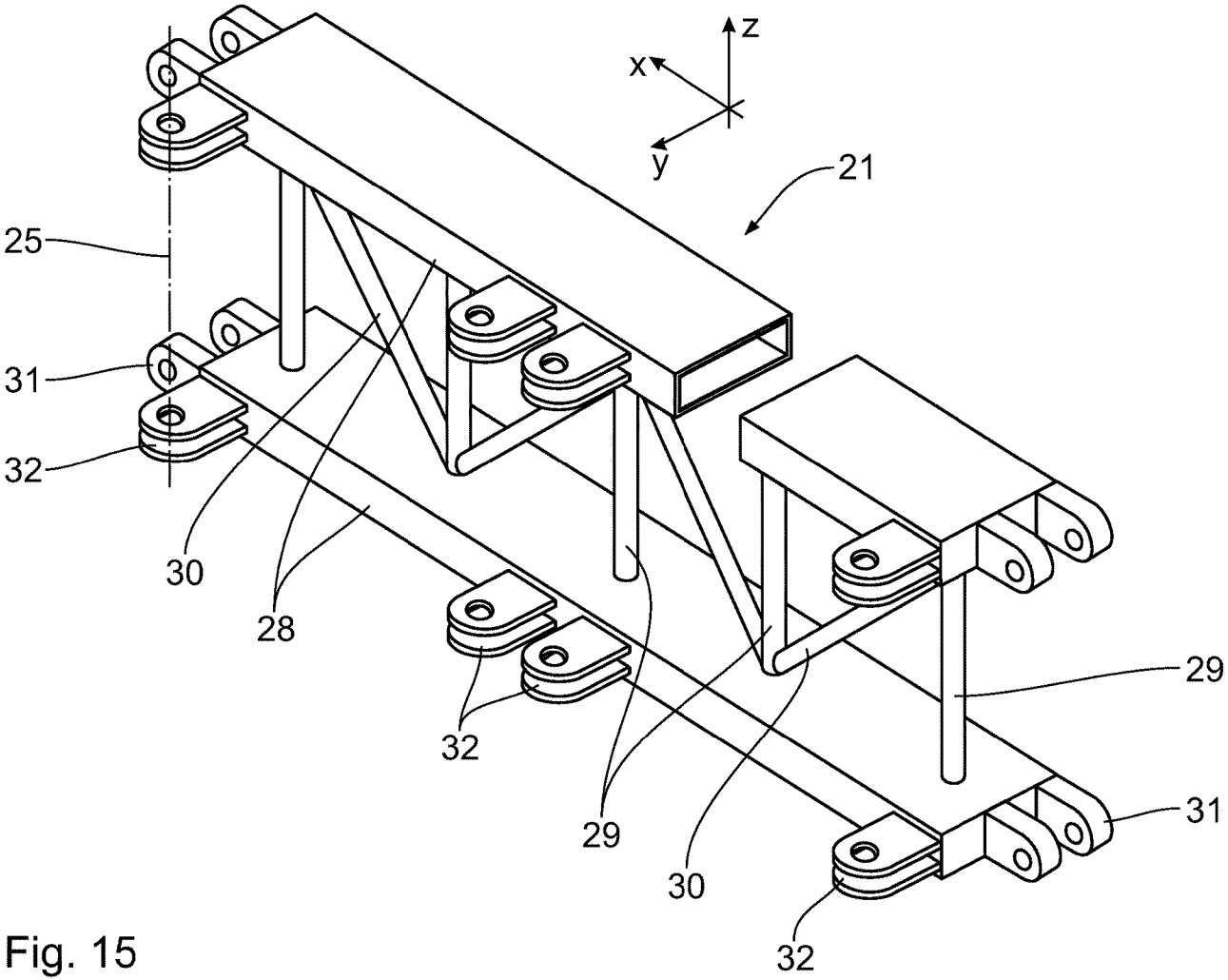
FIG. 15 shows a partially cut perspective detail view of a longitudinal element of the lattice mast element in FIG. 7.

The design of a two-dimensional load bearing structure in the form of a longitudinal element 21 and in particular the design of the chord elements 28 used for this purpose will be explained in more detail in the following sections with reference to FIG. 15. The longitudinal element 21 comprises two chord elements 28 extending along the x-axis, which is parallel to the lattice mast element longitudinal axis 20. The chord elements 28 are rectangular hollow profiles having a rectangular cross-section in the yz-plane that has a greater dimension along the y-axis, in other words along the width of the lattice mast element, than along the z-axis, in other words along the height of the lattice mast element. This means that the chord element 28 has an axial geometrical moment of inertia about the z-axis that is greater than an axial geometrical moment of inertia about the y-axis. As a result, the stiffness of the entire lattice mast element 15 to withstand a lateral force applied in the width along the y-axis is increased additionally. The chord elements 28 of the longitudinal element 21 are supported by the null bars 29 and the diagonal bars 30 in the height, in other words along the z-axis. The risk of bending is thus reduced. In a width, in other words along the y-axis, the longitudinal element 21 is supported in three positions, namely in two respective positions adjacent to the ends of the chord elements 28 and in a central region of the chord elements 28 along the lattice mast element longitudinal axis 20. This means that the bending length is increased along the y-axis. The rectangular hollow profile of the chord element 28 therefore has an increased section modulus in the direction of the y-axis. FIG. 15 further shows the fork and lug parts 31 provided at the ends of the chord elements 28, said fork and lug parts 31 being used to interconnect two lattice mast elements 15 along the lattice mast element longitudinal axis 13. FIG. 15 also shows the null bars 29 and the diagonal bars 30 of the longitudinal element 21. Articulating elements 32 for the pivot axis 25 are fastened to the chord elements 28, in particular by welding. The pivot axes 25 are in particular arranged at a distance from a plane spanned by the longitudinal elements 21, the plane being oriented parallel to the xz-plane. Said distance between the pivot axes 25 and the longitudinal element 21 is achieved by means of the articulating elements 32.

The chord elements 28 have a flat, wide hollow profile shape. This improves a transverse stability and transverse stiffness of the longitudinal element 21 formed by the chord elements 28. The longitudinal elements 21 are side parts of the lattice boom. Due to the longitudinal elements 21, the lattice boom has an increased transverse stability and transverse stiffness, the longitudinal elements 21 being connected, via the bracing elements 24, to at least one transverse element 22 so as to be braced thereby. The transverse stability or transverse stiffness of the longitudinal element 21 refers to its resistance to a transverse load. The flat, wide chord elements 28 interconnected by null bars 29 and diagonal bars 30 produce a longitudinal element 21 that has an increased stiffness and stability in a height, in other words along the z-axis according to FIG. 15. Due to the increased transverse stiffness of the longitudinal elements 21, the number of bracing elements 24 parallel to the load bearing surface can be reduced, with the result that less material is required to produce a lattice mast element of this type. The lattice mast element has a lightweight design.

In the following sections, the displacement of the adapter lattice mast element 14 from the working arrangement in FIG. 16 into the transport arrangement in FIG. 17 will be explained in more detail. The adapter lattice mast element 14 is identical to the adapter lattice mast element 16. The adapter lattice mast element 14 has a trapezoidal load bearing surface 19. At an upper end shown in FIG. 16, the load bearing surface 19 is limited by two transverse elements 22 interconnected by a connection element 23. At a lower end, only one transverse element 22 is provided to bridge a distance between the two longitudinal elements 21. In order to provide additional bracing, additional transverse elements 22, which are interconnected by a connection element 23, are provided in addition to the bracing elements 24 in an approximately central region of the adapter lattice mast element 14 when seen along the lattice mast element longitudinal axis 20. Along the lattice mast longitudinal axis 20, the adapter lattice mast element 14 has a variable lattice mast width B. The lattice mast width $B_{min}$ is minimal at the lower transverse element 22. The lattice mast element width $B_{max}$ is maximal at the upper end.

Figure 17:
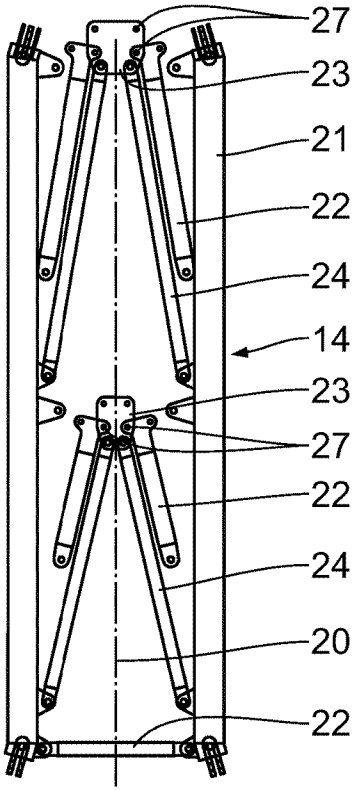
FIG. 17 shows the adapter lattice mast element according to FIG. 16 in a transport arrangement.
Figure 16:
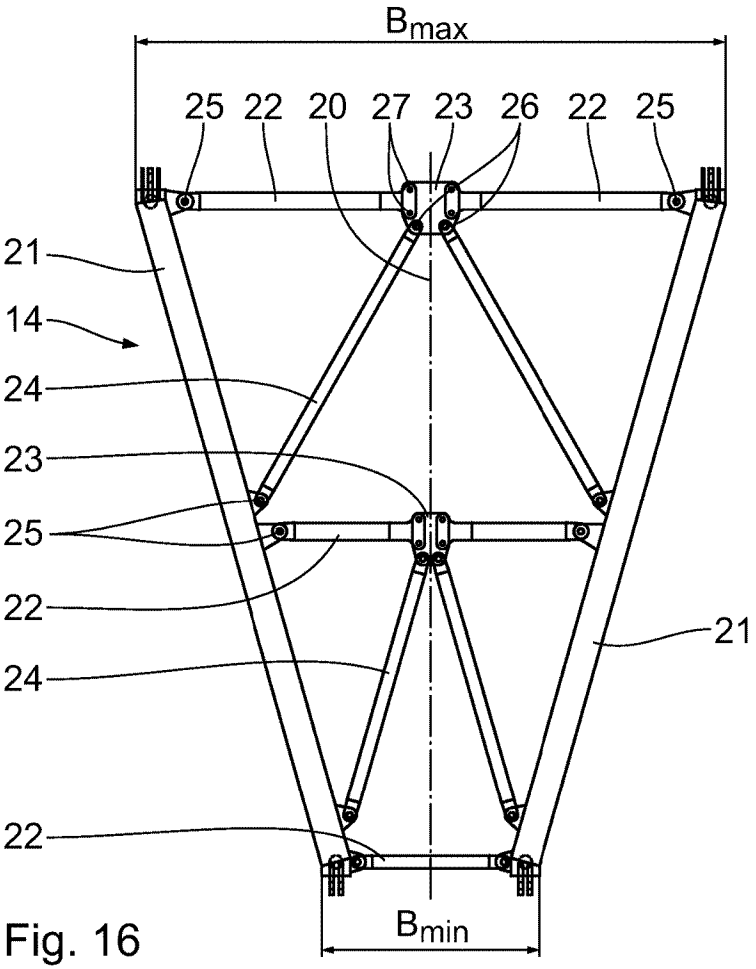
FIG. 16 shows a view, corresponding to FIG. 12, of an adapter lattice mast element in a working arrangement.
Figure 19:
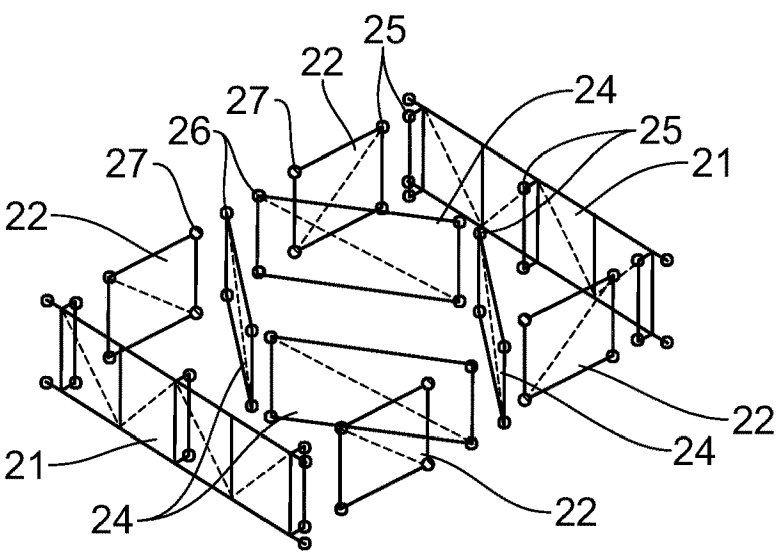
FIG. 19 shows an exploded view of the lattice mast element according to FIG. 18.
Figure 18:
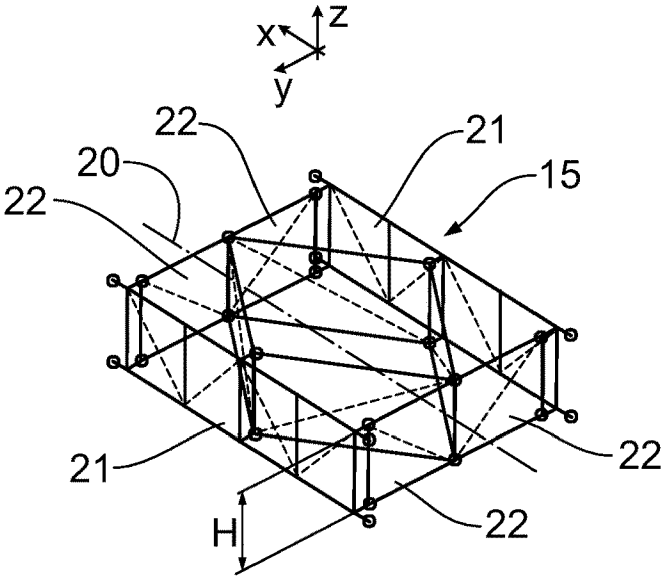
FIG. 18 shows a diagrammatic perspective view, corresponding to FIG. 4, of a lattice mast element according to another embodiment.
Figure 20:
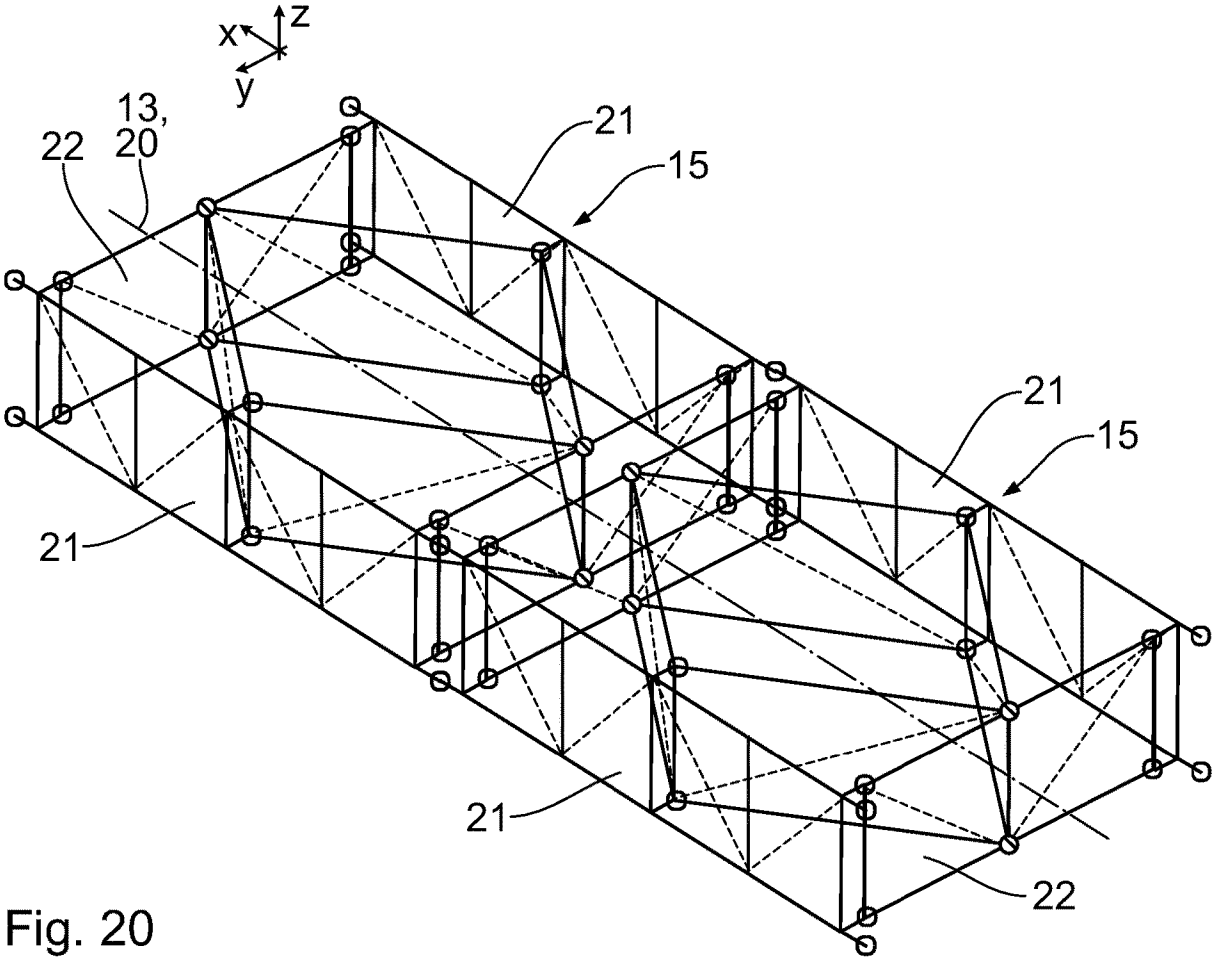
FIG. 20 shows a diagrammatic view comprising two lattice mast elements according to FIG. 18 arranged one behind the other along a lattice mast element longitudinal axis.
Figure 22:
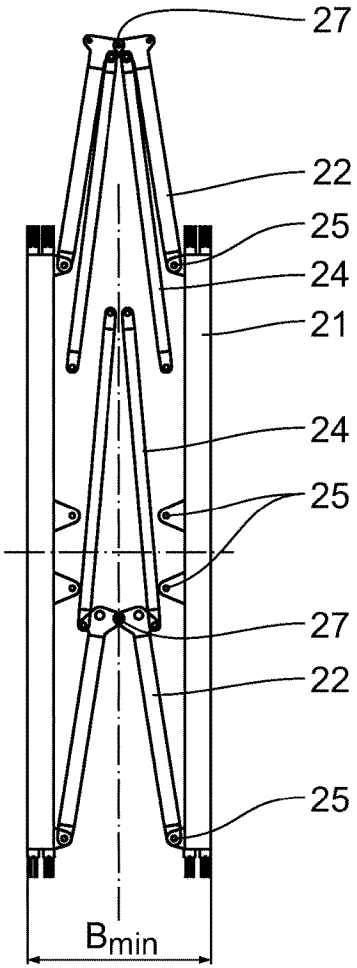
FIG. 22 shows the lattice mast element according to FIG. 21 in a transport arrangement.
Figure 21:
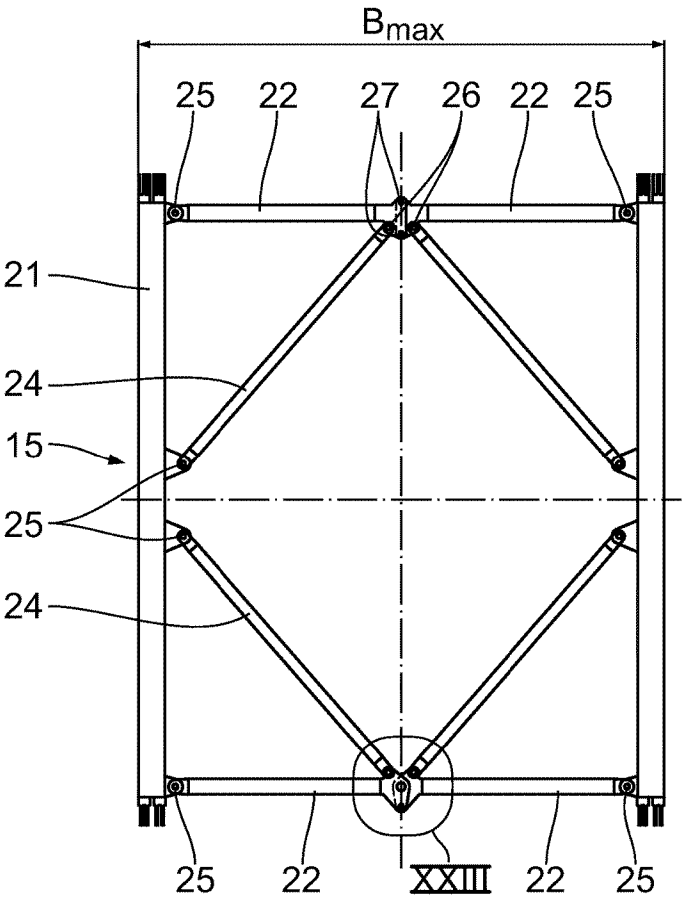
FIG. 21 shows a view, corresponding to FIG. 18, of a lattice mast element in a working arrangement.
Figure 23:
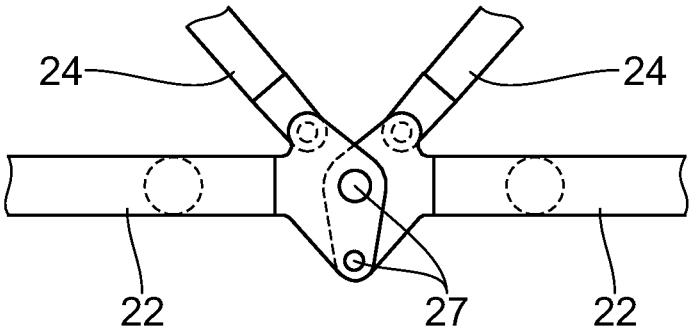
FIG. 23 shows an enlarged view of detail XXIII in FIG. 21.
Figure 25:
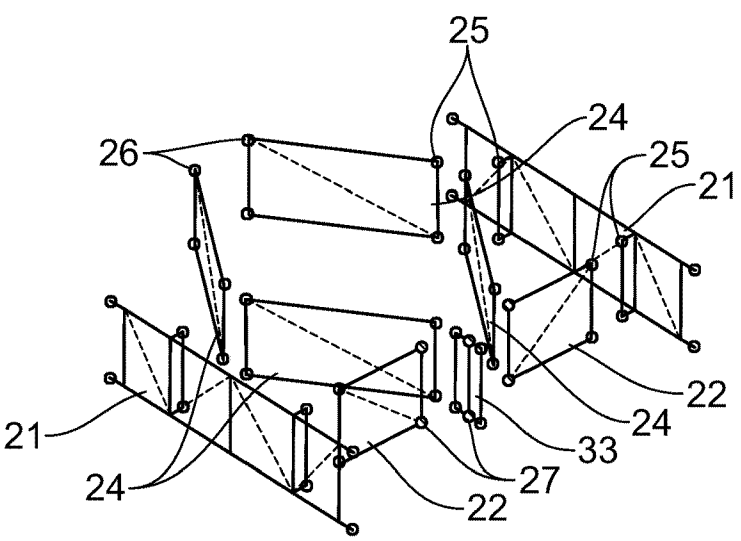
FIG. 25 shows an exploded view corresponding to FIG. 24.
Figure 24:
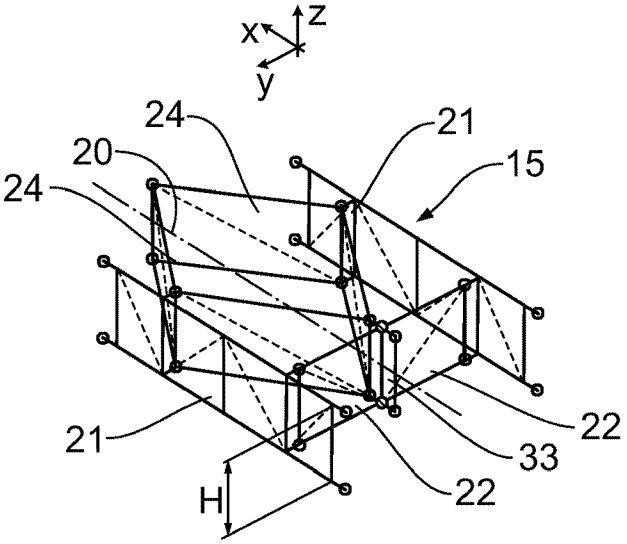
FIG. 24 shows a diagrammatic perspective view, corresponding to FIG. 4, of another embodiment of a lattice mast element.
Figure 26:
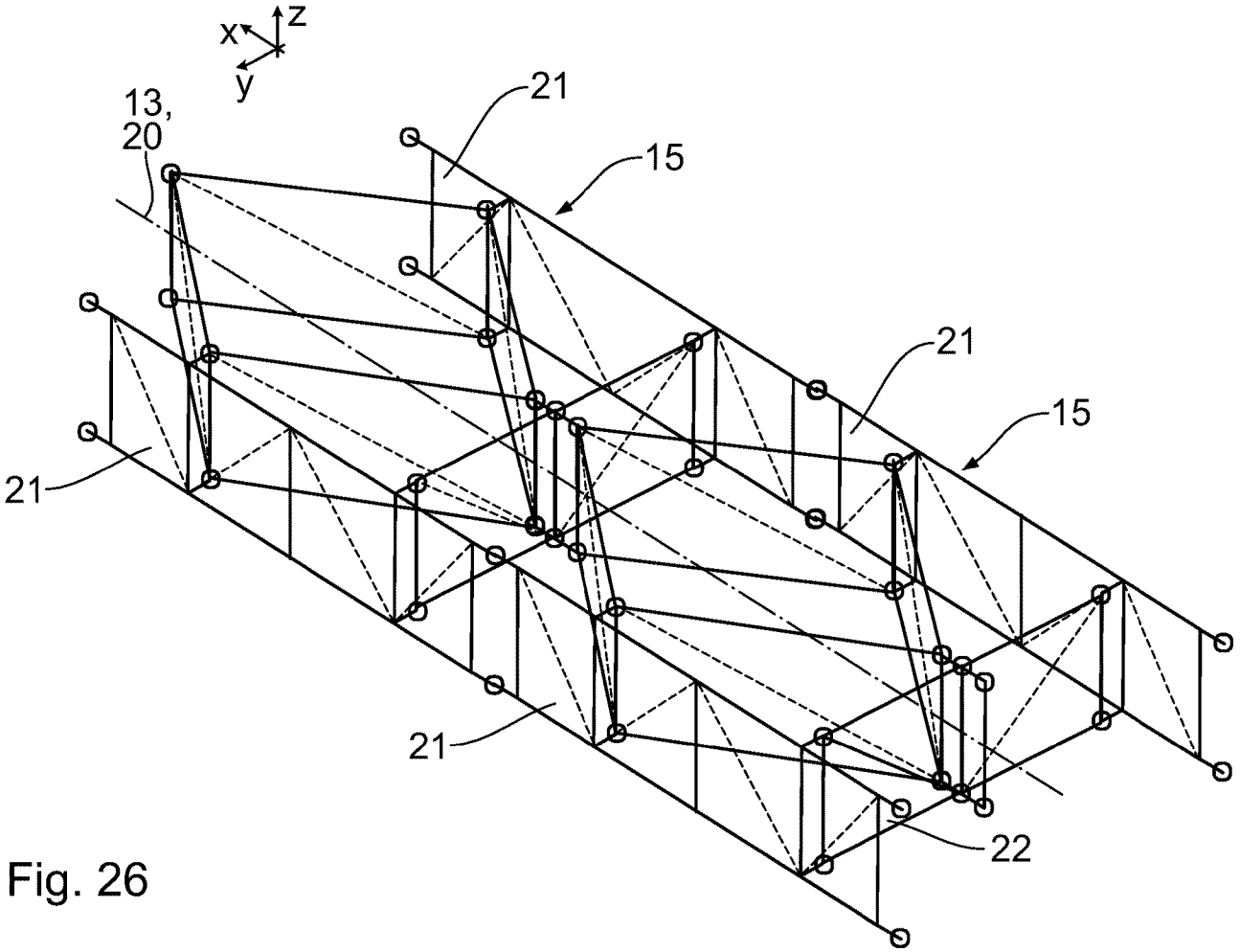
FIG. 26 shows a diagrammatic view of a lattice boom comprising two lattice mast elements according to FIG. 24 arranged one behind the other along a lattice mast element longitudinal axis.

In order to move the adapter lattice mast element 14 from the working arrangement shown in FIG. 16 into the transport arrangement shown in FIG. 17, the central transverse elements 22 are detached from the longitudinal elements 21 in the region of the pivot axes 25. At the same time, the central transverse elements of one of the connection axes 27 are detached from the connection element 23 and pivoted downwards on the connection element 23. The upper transverse elements are detached from the respective upper connection axes 27 of the connection element 23 and from the pivot axes 25 of the longitudinal elements 21 and pivoted downwards as well. The two upper ends of the longitudinal elements 21 are each pivoted towards the lattice mast element longitudinal axis 20 until the longitudinal elements 21 are parallel to each other and parallel to the lattice mast element longitudinal axis 20. In this arrangement, the adapter lattice mast element 14 has a width that is constant along the lattice mast element longitudinal axis 20, said width corresponding to the minimum width $B_{min}$ of the adapter lattice mast element in the working arrangement. In the working arrangement according to claim 16, the two longitudinal elements 21 are arranged at an angle relative to the lattice mast element longitudinal axis 20. An angle of inclination is approximately 15°. The angle of inclination can be adapted accordingly to allow a corresponding change in cross-section from the lattice mast elements 17 to the lattice mast elements 15 and from the lattice mast elements 15 to the foot element 12.

In particular, the angle of inclination may be greater than 15° or smaller than 15°. The longitudinal elements 21 are arranged relative to each other along the lattice mast element longitudinal axis 20 at the angle of inclination substantially as described above.

FIG. 18 to FIG. 23 show another embodiment of a lattice mast element 15. Components corresponding to those already explained above with reference to FIGS. 1 to 17 are designated by the same reference numerals and are not discussed in detail again.

The most important difference compared to the preceding exemplary embodiment of a lattice mast element is that the transverse elements 22 of the lattice mast element 15 and the bracing elements 24 articulated thereto are directly interconnected. In particular, the use of a connection element 23 is not necessary. The interconnection between the elements is shown in the enlarged detail view according to FIG. 23.

The lattice mast element 15 according to this embodiment has a simpler design because of the unnecessary connection element. In particular, a design of this type is weight-reduced and uncomplicated. In order to provide a sufficient amount of space between the longitudinal elements 21 in the transport arrangement for a displacement of the lattice mast element 15 from the working arrangement shown in FIG. 21 into the transport arrangement shown in FIG. 22, the transverse elements shown at the top of FIGS. 21, 22 need to be configured differently than the transverse elements 22 shown at the bottom of FIGS. 21, 22. The transport arrangement according to FIG. 22 substantially corresponds to the transport arrangement in FIG. 8. Starting from the working arrangement in FIG. 21, the lattice mast element width $B_{max}$ is reduced considerably compared to the minimum transport element width $B_{min}$ in FIG. 22.

Despite the comparatively simple design of the lattice mast element without connection elements, it is possible to produce a torque-proof interconnection between the transverse elements 22. This is achieved in that the connection axes 27 are produced by openings in the transverse elements 22, the openings being arranged in pairs in such a way as to be flush with each other. The openings are arranged flush with each other only in the working arrangement of the lattice mast element according to FIG. 21. Bolts are inserted into the openings arranged flush with each other for bracing.

FIGS. 24 to 29 show another embodiment of a lattice mast element 15. Components corresponding to those descried above with reference to FIGS. 1 to 23 are designated by the same reference numerals and are not discussed in detail again.

The lattice mast element 15 differs from the preceding exemplary embodiments in that by means of the connection element 33 two transverse elements 22 can be interconnected while four bracing elements 24 can be articulated thereto. Along the lattice mast element longitudinal axis 20, two of these four bracing elements 24 are arranged above the transverse elements 11 while the other two are arranged below the transverse elements 11. As a result, only one connection element 33 is required for one lattice mast element 15. A lattice mast element 15 according to the embodiment in FIG. 24 to FIG. 29 requires less material, thus allowing both costs and weight to be reduced. Furthermore, the bracing elements 24 of a lattice mast element 15 extend along the lattice mast element longitudinal axis 20 beyond the fork/lug parts 31 over to an adjacent lattice mast element 15. As a result, a lattice boom outlined in FIG. 29 is additionally braced along the lattice mast longitudinal axis 13, the lattice boom comprising a plurality of lattice mast elements 15.

Figure 28:
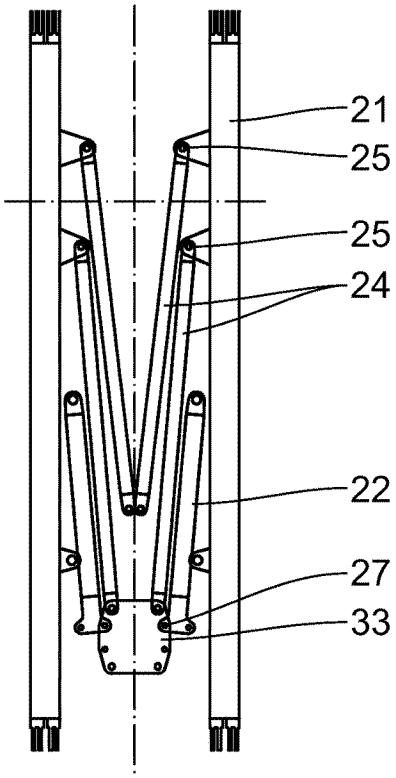
FIG. 28 shows the lattice mast element according to FIG. 27 in a transport arrangement.
Figure 27:
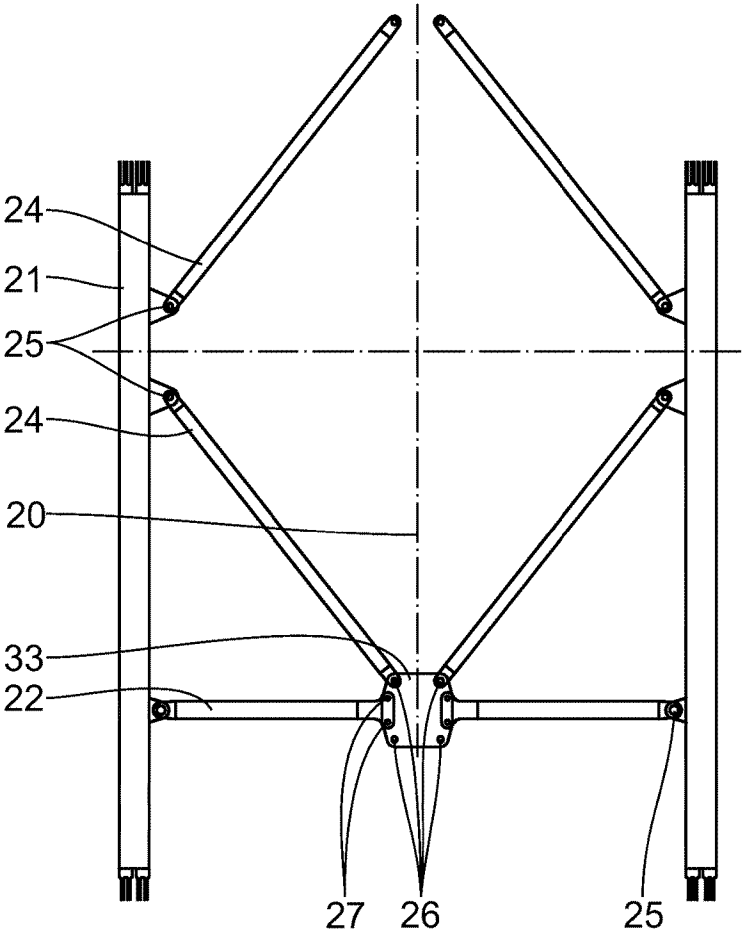
FIG. 27 shows a plan view of an actual exemplary embodiment of a lattice mast element according to FIG. 24 in a working arrangement.
Figure 29:
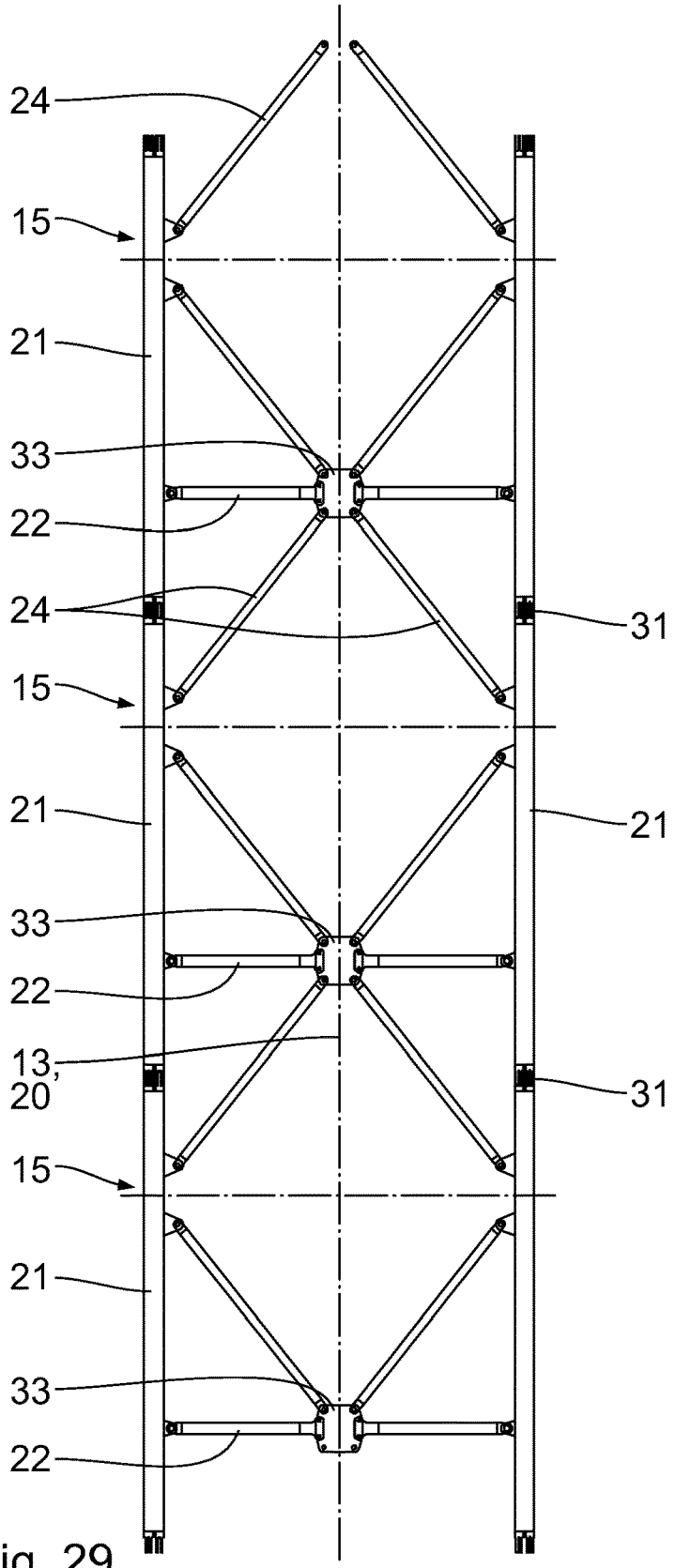
FIG. 29 shows a plan view, corresponding to FIG. 27, of a plurality of lattice mast elements arranged one behind the other along a lattice mast element longitudinal axis.

For the displacement from the working arrangement shown in FIG. 27 into the transport arrangement shown in FIG. 28, all bracing elements 24 and the transverse elements 22 detached from the connection element 33 of a respective connection axis 27 are pivoted in a direction, namely downwards according to FIG. 28, and arranged in a V-shaped configuration relative to each other. A transport arrangement of the lattice mast element 15 of this type is particularly advantageous since the transport length is minimal and corresponds to the length of the longitudinal elements 21 along the lattice mast element longitudinal axis 20. This means that in the transport arrangement shown in FIG. 28, the transverse elements 22 and the connection elements 24 do not protrude beyond the longitudinal elements 21 along the lattice mast element longitudinal axis 20.

Figure 31:
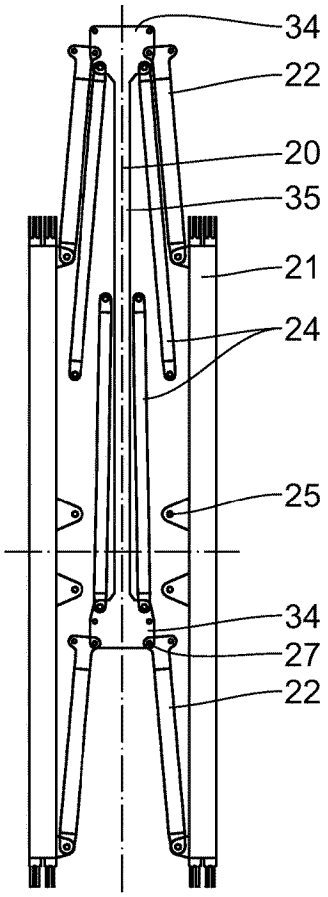
FIG. 31 shows the lattice mast element according to FIG. 30 in a transport arrangement.
Figure 30:
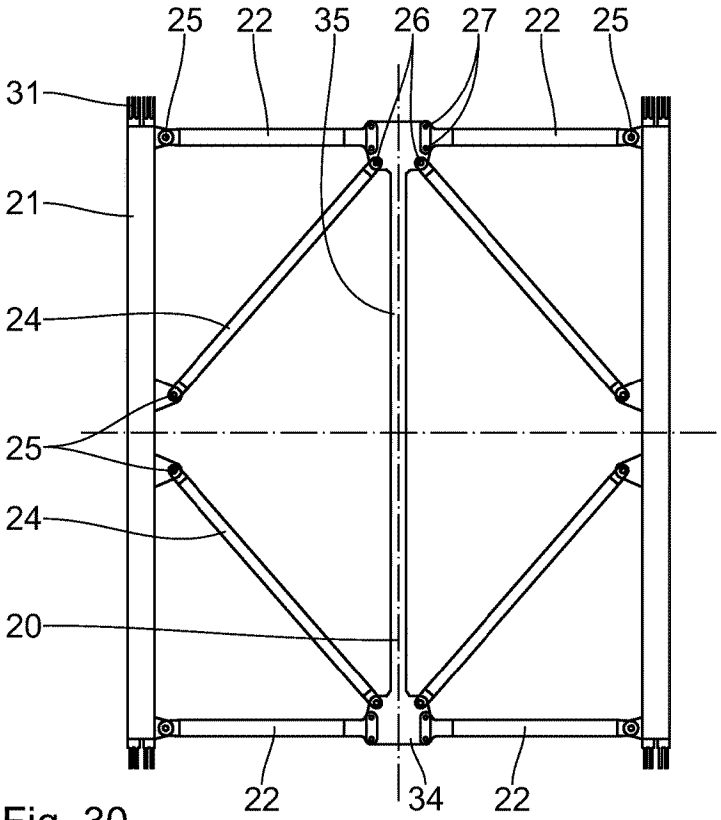
FIG. 30 shows a plan view, corresponding to FIG. 7, of another embodiment of a lattice mast element in a working arrangement.

FIGS. 30 and 31 show another embodiment of a lattice mast element 15. The lattice mast element 15 substantially corresponds to the lattice mast element according to the first embodiment in FIG. 7, with the two connection elements 34 being rigidly interconnected by a longitudinal bar 35. The longitudinal bar 35 may in particular also be configured as a longitudinal two-dimensional load bearing structure. The lattice mast element has an increased stiffness. The displacement from the working arrangement in FIG. 30 into the transport arrangement in FIG. 31 is performable in a stable manner since all components to be moved, in other words the connection elements 34 coupled to each other and the transverse elements 22 and bracing elements 24 articulated thereto in a pivotable manner, are displaced at the same time in a guided manner.

Figure 33:
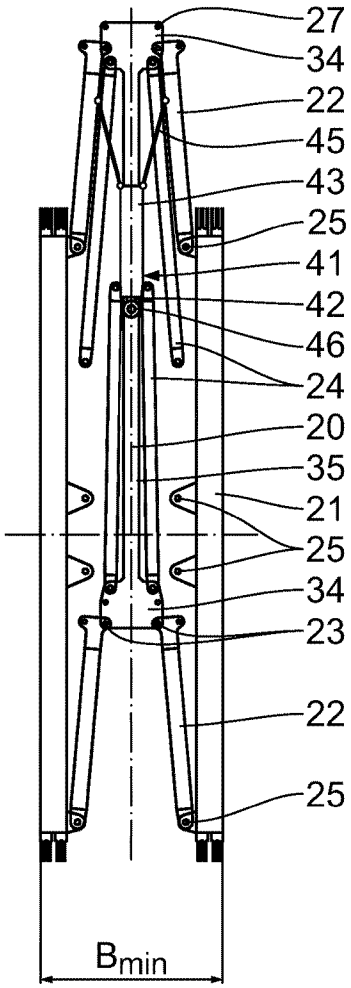
FIG. 33 shows the lattice mast element according to FIG. 32 in a transport arrangement.
Figure 32:
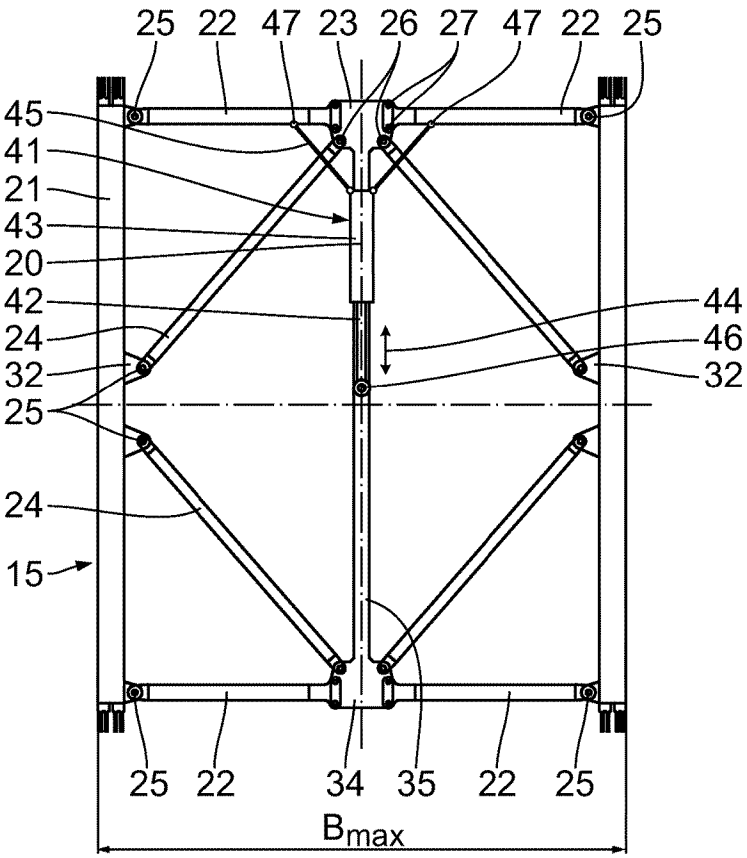
FIG. 32 shows a plan view, corresponding to FIG. 30, of another embodiment of a lattice mast element in a working arrangement, the lattice mast element being provided with a drive element.

FIGS. 32 and 33 show another embodiment of a lattice mast element 15. Components corresponding to those already explained above with reference to FIGS. 1 to 31 are designated by the same reference numerals and are not discussed in detail again.

The lattice mast element 15 according to this embodiment substantially corresponds to the lattice mast element according to the embodiment in FIG. 30, 31. The most important difference is that a drive element 41 is provided. According to the illustrated embodiment, the drive element 41 is configured as a piston cylinder unit in the form of a hydraulic cylinder. The hydraulic cylinder 41 has a piston rod 42 that is pivotably articulated to the longitudinal bar 35 about a pivot axis oriented parallel to the z-axis. The drive element 41 is telescopable in such a way that the piston rod 42 is extendable from a cylinder housing 43 and retractable into said cylinder hosing 43 along a cylinder longitudinal axis 44. To this end, the hydraulic cylinder 41 is connected to a hydraulic unit of the crane via hydraulic lines not shown. The cylinder housing 43 is articulated, via two link bars 45, to in each case one of the transverse elements 22.

In the working arrangement of the lattice mast element 15 shown in FIG. 32, the piston rod 42 is extended from the cylinder housing 43 to an in particular maximum extent. The displacement from the working arrangement of the lattice mast element 15 shown in FIG. 32 into the transport arrangement thereof shown in FIG. 33 is substantially performed in a manner similar to that described with reference to the embodiment according to FIGS. 30 and 31 to which reference is made. The displacement between the arrangements according to FIGS. 32 and 33 is additionally facilitated by the actuation of the drive element 41. Starting from the working arrangement in FIG. 32, the piston rod 42 is retracted into the cylinder housing 43 along the cylinder longitudinal axis 44, causing the distance between the pivot axis 46 and the pivot axis 47 to be reduced in such a way that the folding process of the lattice mast element 15 is facilitated.

The drive element 41 may also be a spindle drive or a hydraulic cylinder operated by means of an electric motor.

In the transport arrangement of the lattice mast element 15 shown in FIG. 33, the piston rod 42 has been retracted into the cylinder housing 43 in particular entirely.

Figure 35:
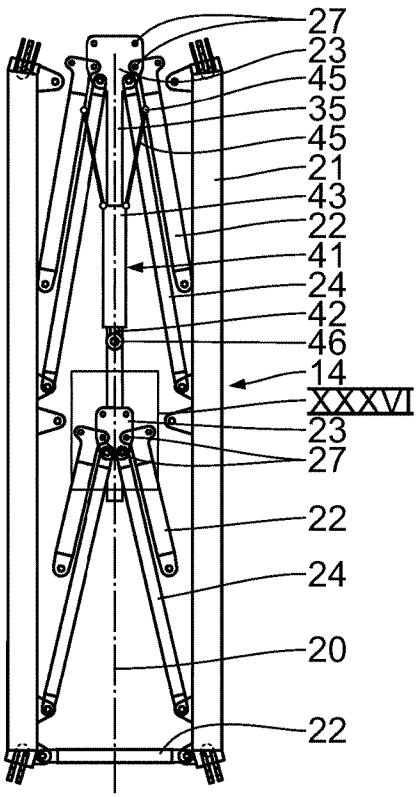
FIG. 35 shows the lattice mast element according to FIG. 34 in a transport arrangement.
Figure 34:
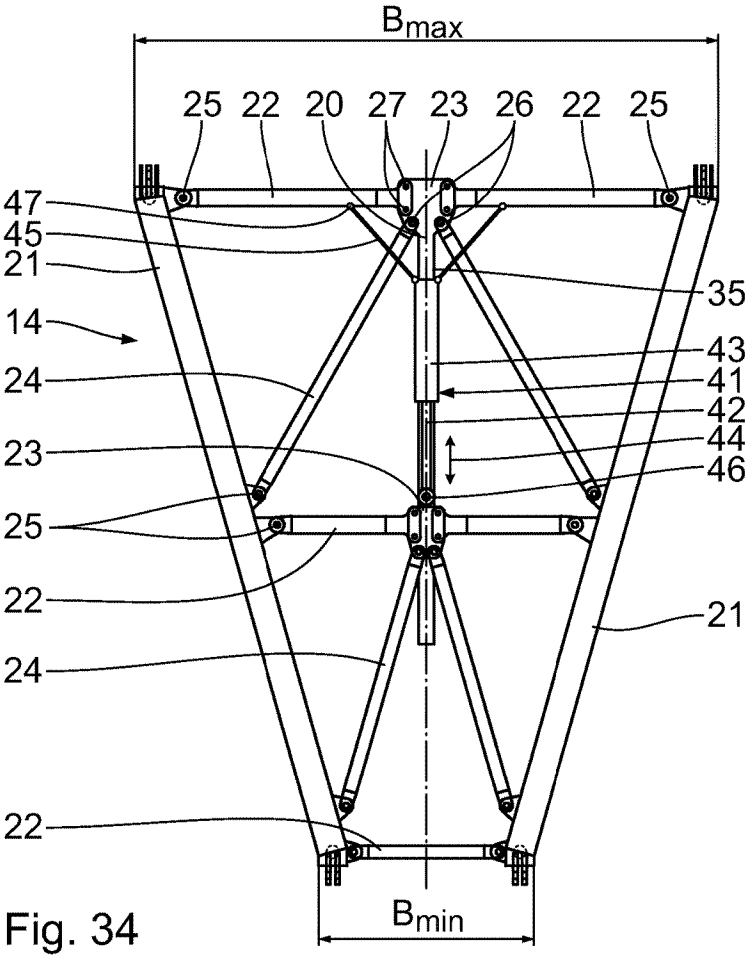
FIG. 34 shows a plan view, corresponding to FIG. 32, of another embodiment of a trapezoidal lattice mast element in a working arrangement, the lattice mast element being provided with a drive element.
Figure 36:
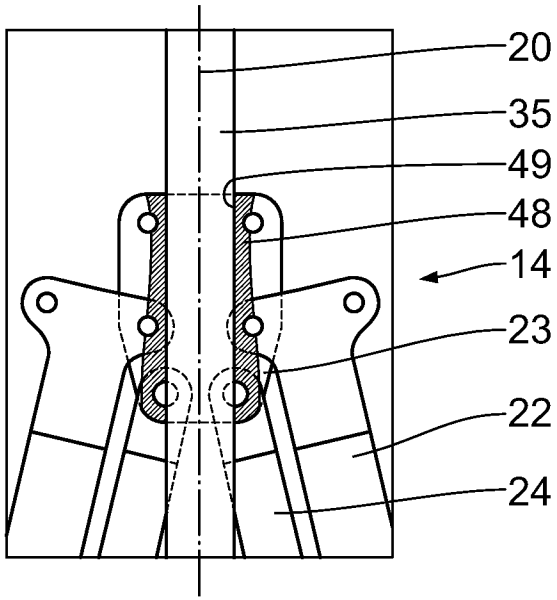
FIG. 36 shows an enlarged, partially cut view of detail XXXVI in FIG. 35.

FIGS. 34 to 36 show another embodiment of an adapter lattice mast element 14. Components corresponding to those described above with reference to FIGS. 1 to 33 are designated by the same reference numerals and are not discussed in detail again.

The adapter lattice mast element 14 substantially corresponds to the adapter lattice mast element 14 shown in FIGS. 16 and 17. The most important difference is that the two connection elements 23 are interconnected by a longitudinal bar 35. The longitudinal bar 35 is formed in one piece with a first connection element 23 shown at the top of FIG. 34. At a second connection element 23 shown at the bottom of FIG. 34, the longitudinal bar 35 is guided for displacement along the lattice mast element longitudinal axis 20. In particular, the interconnection of the connection elements 23 provided by the longitudinal bar 35 is not rigid. In the partially cut detail view according to FIG. 36, the guidance of the longitudinal bar 35 at the connection element 23 is shown diagrammatically by guide elements 48 configured as a slide bushing 49. This means that the longitudinal bar 35 may be guided through an opening formed by the slide bushing 49. An external diameter of the longitudinal bar 35 is smaller than or equal to, and in particular smaller than an internal diameter of the opening of the slide bushing 49.

A drive element 41 is provided to facilitate a displacement from the working arrangement of the adapter lattice mast element 14 shown in FIG. 34 into the transport arrangement shown in FIG. 35. The drive element 41 corresponds to the drive element according to the preceding embodiment. As far as the mechanism for displacing the adapter lattice mast element 14 between the two arrangements shown in FIGS. 34 and 35 is concerned, reference is made to the explanations concerning the embodiment according to FIGS. 16 and 17.

Figure 38:
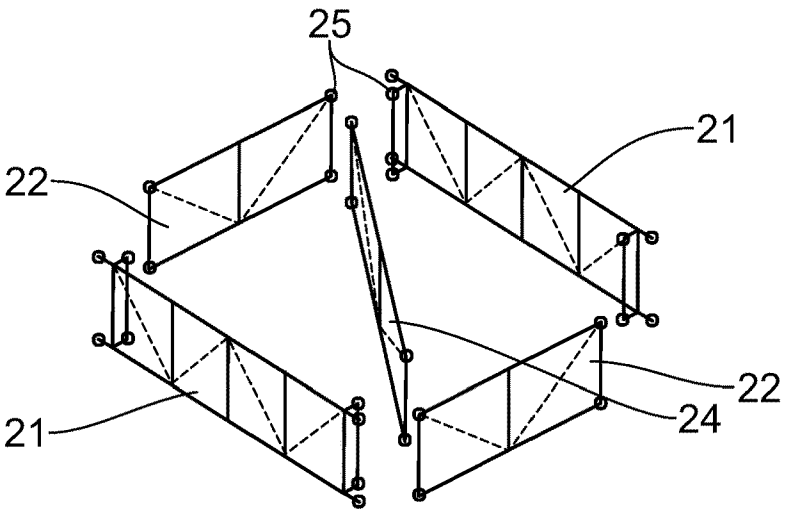
FIG. 38 shows an exploded view of the lattice mast element in FIG. 37.
Figure 37:
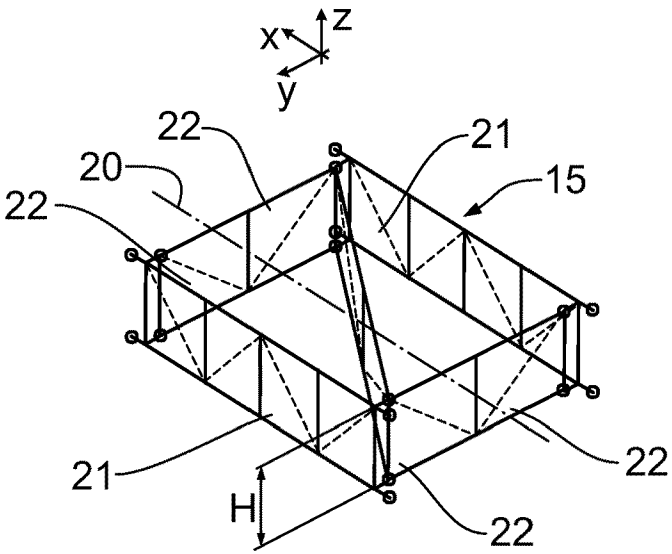
FIG. 37 shows a diagrammatic perspective view, corresponding to FIG. 4, of a lattice mast element according to another embodiment.
Figure 39:
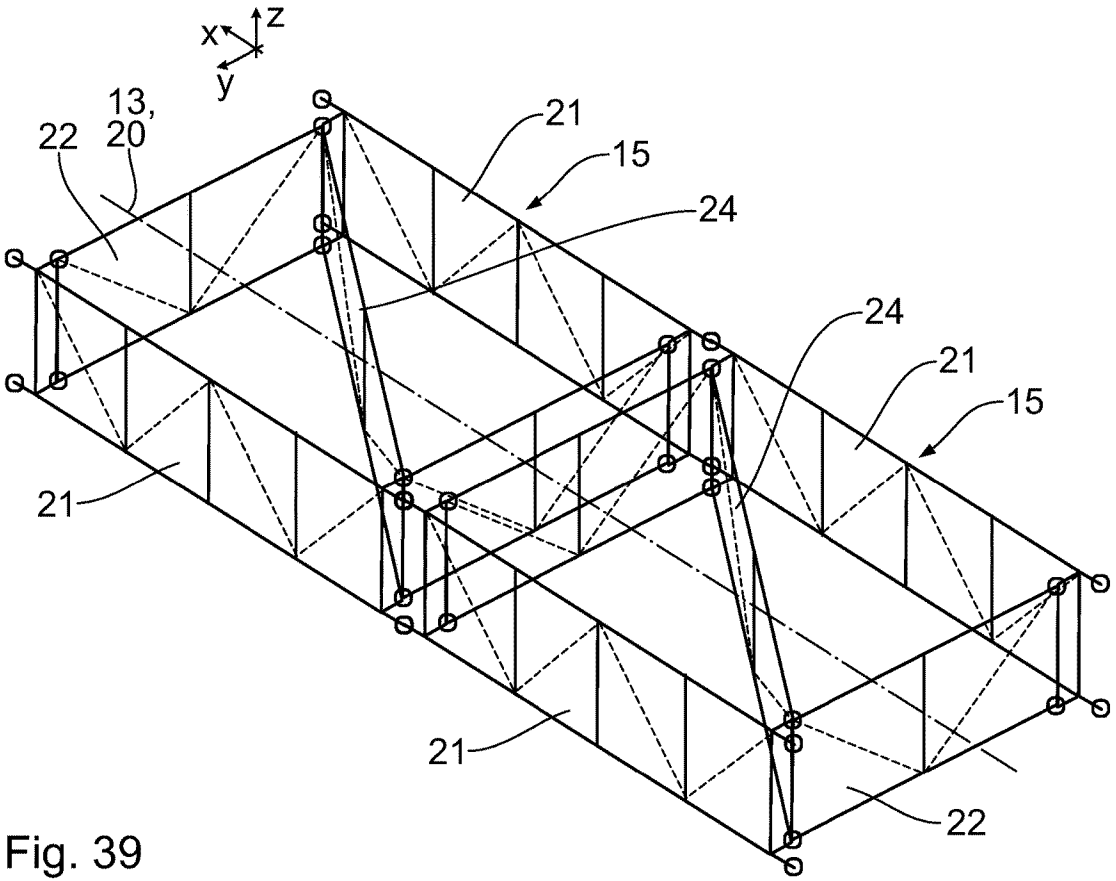
FIG. 39 shows a diagrammatic view of a lattice boom comprising a plurality of lattice mast elements according to FIG. 37 arranged one behind the other along a lattice mast element longitudinal axis.

FIGS. 37 to 39 show another embodiment of a lattice mast element 15. Components corresponding to those explained above with reference to FIGS. 1 to 36 are designated by the same reference numerals and are not discussed in detail again.

The lattice mast element 15 differs from the preceding embodiments substantially in that the bracing elements 24 are arranged relative to the load bearing surface in a diagonal instead of a rhombical configuration. The longitudinal elements 21 are interconnected by in each case one transverse element 22. In order to displace the lattice mast element 15 from a working arrangement into a transport arrangement, the connections between the illustrated elements are removed. In particular because only five elements are required for each lattice mast element, namely two longitudinal elements 21, two transverse elements 22 and one bracing element 24, disassembly may be performed in a rapid and simple manner. It is in particular possible that only four connections, namely those in the corner regions of the load bearing surface, need to be removed to transport the two longitudinal elements 21. The two transverse elements 22 can be folded such as to abut against the sides of the bracing element 24. The effort required for a displacement from the transport arrangement into the working arrangement is reduced.

Figure 40:
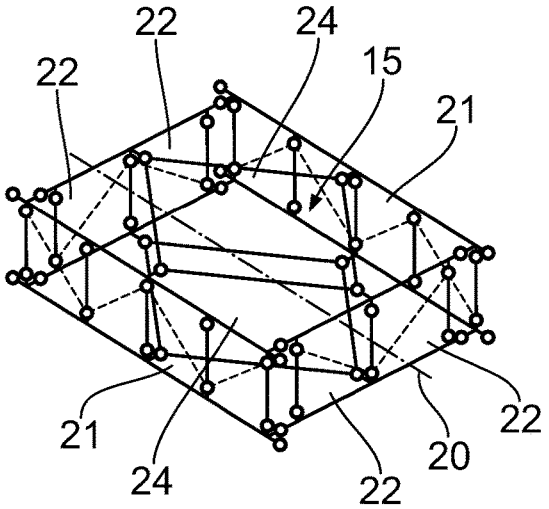
FIG. 40 shows a diagrammatic perspective view, corresponding to FIG. 4, of a lattice mast element according to another embodiment.
Figure 41:
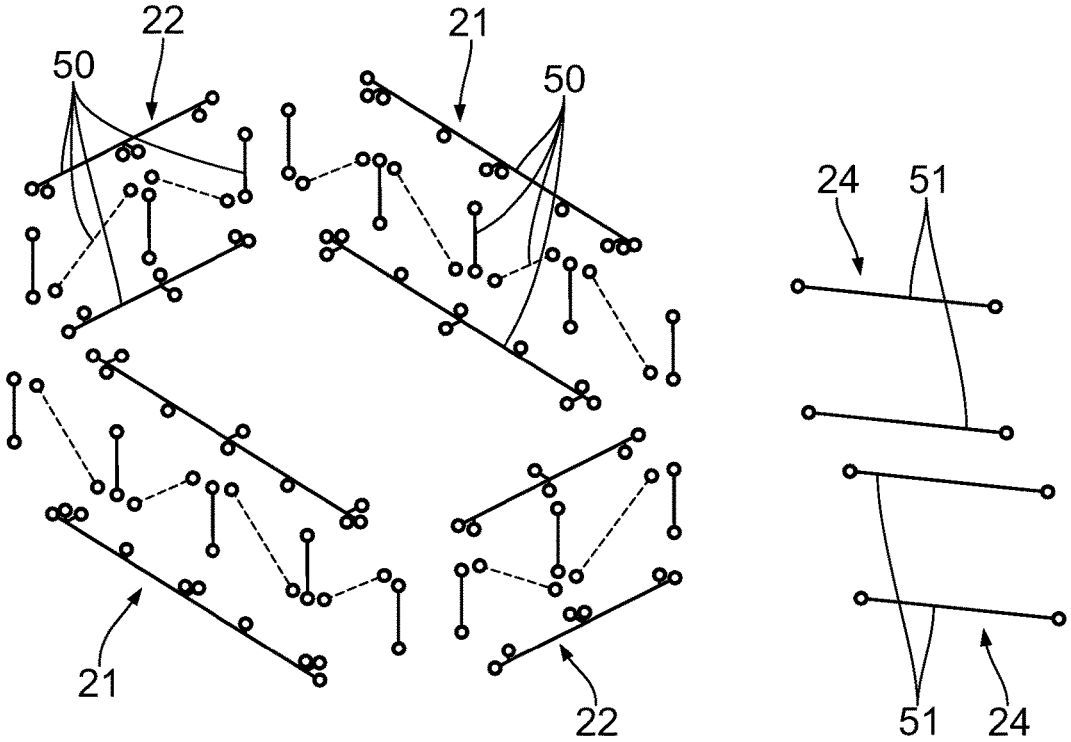
FIG. 41 shows an exploded view of the lattice mast element in FIG. 40.
Figure 42:
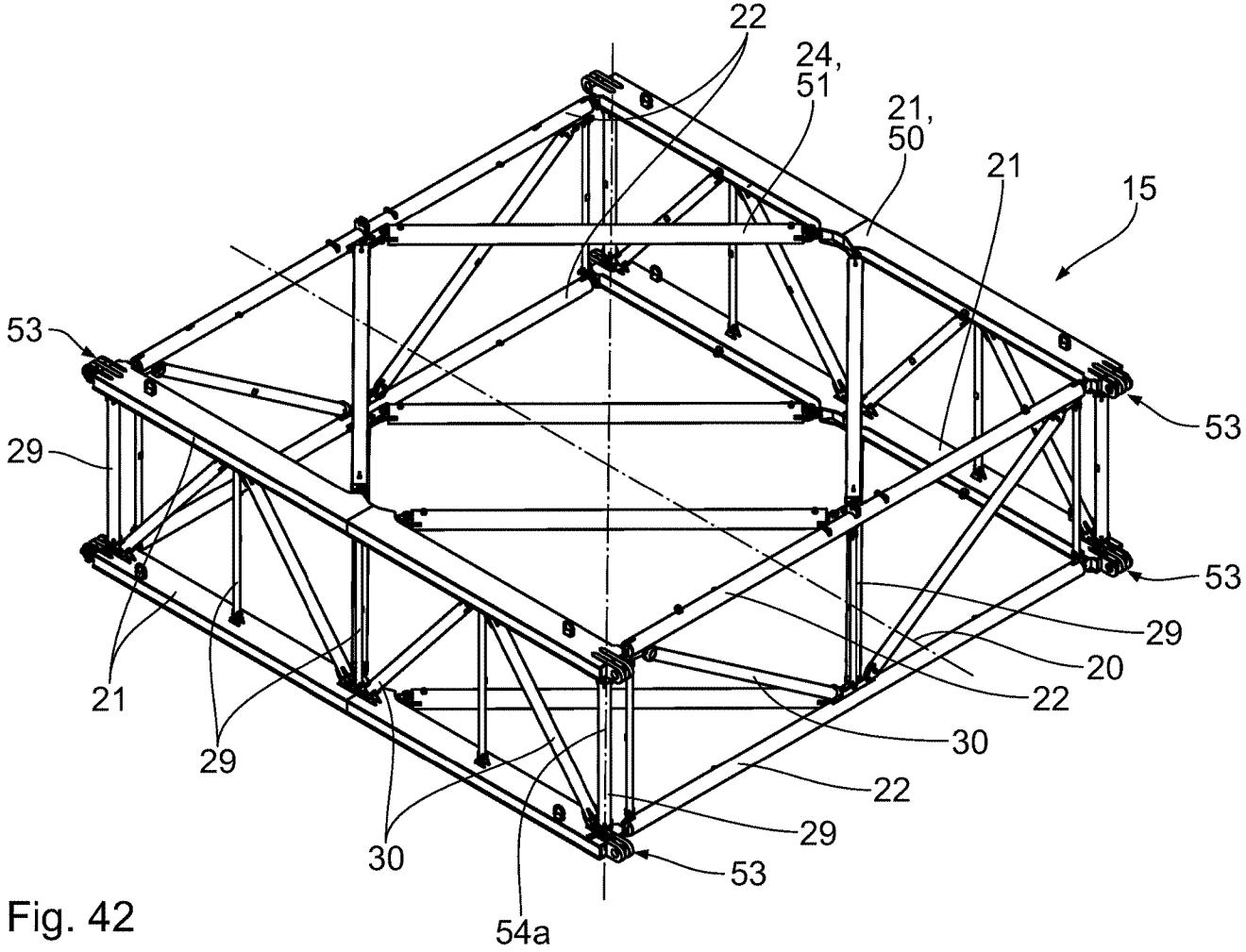
FIG. 42 shows a perspective view of the lattice mast element according to the exemplary embodiment in FIGS. 40, 41.

FIGS. 40 to 42 show another embodiment of a lattice mast element 15. Components corresponding to those explained above with reference to FIGS. 1 to 39 are designated by the same reference numerals and are not discussed in detail again.

The lattice mast element 15 substantially corresponds to the lattice mast element 15 according to FIG. 4. The most important difference is that the longitudinal elements 21 and transverse elements 22 are two-dimensional load bearing structures which are however not configured in one piece. This is in particular shown by the exploded view according to FIG. 41. The longitudinal elements 21 and the transverse elements 22 are each made of a plurality of individual components 50 that are interconnectable using bolts. This means that the individual components 50 are interconnectable detachably. The individual components 50 of the longitudinal elements 21 have chord elements oriented in particular along the x-axis, in other words parallel to the lattice mast element longitudinal axis 20. The chord elements are interconnected by a plurality of null bars and transverse bars. Correspondingly, the individual components 50 of the transverse elements 22 comprise chord elements oriented parallel to the y-axis, in other words along the lattice mast element width, said chord elements being in each case interconnected by a plurality of null bars oriented parallel to the z-axis and transverse bars arranged therebetween.

Figure 5:
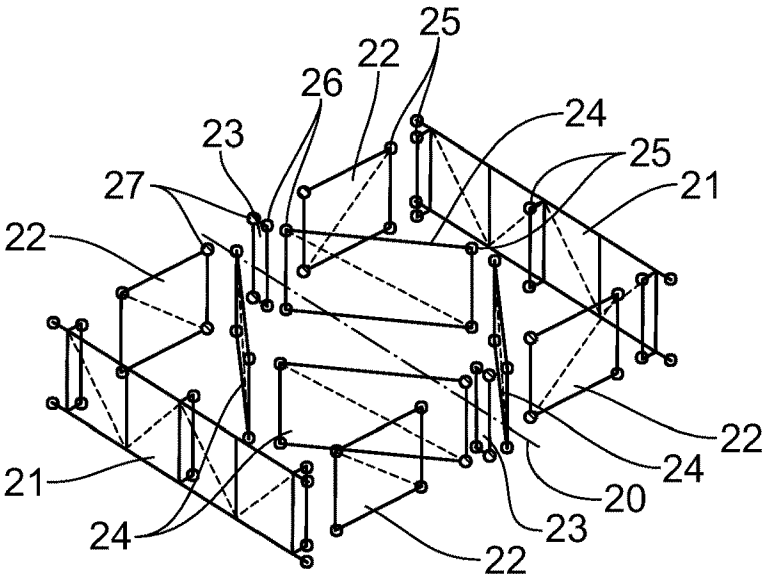
FIG. 5 shows an exploded view of the lattice mast element in FIG. 4.
Figure 6:
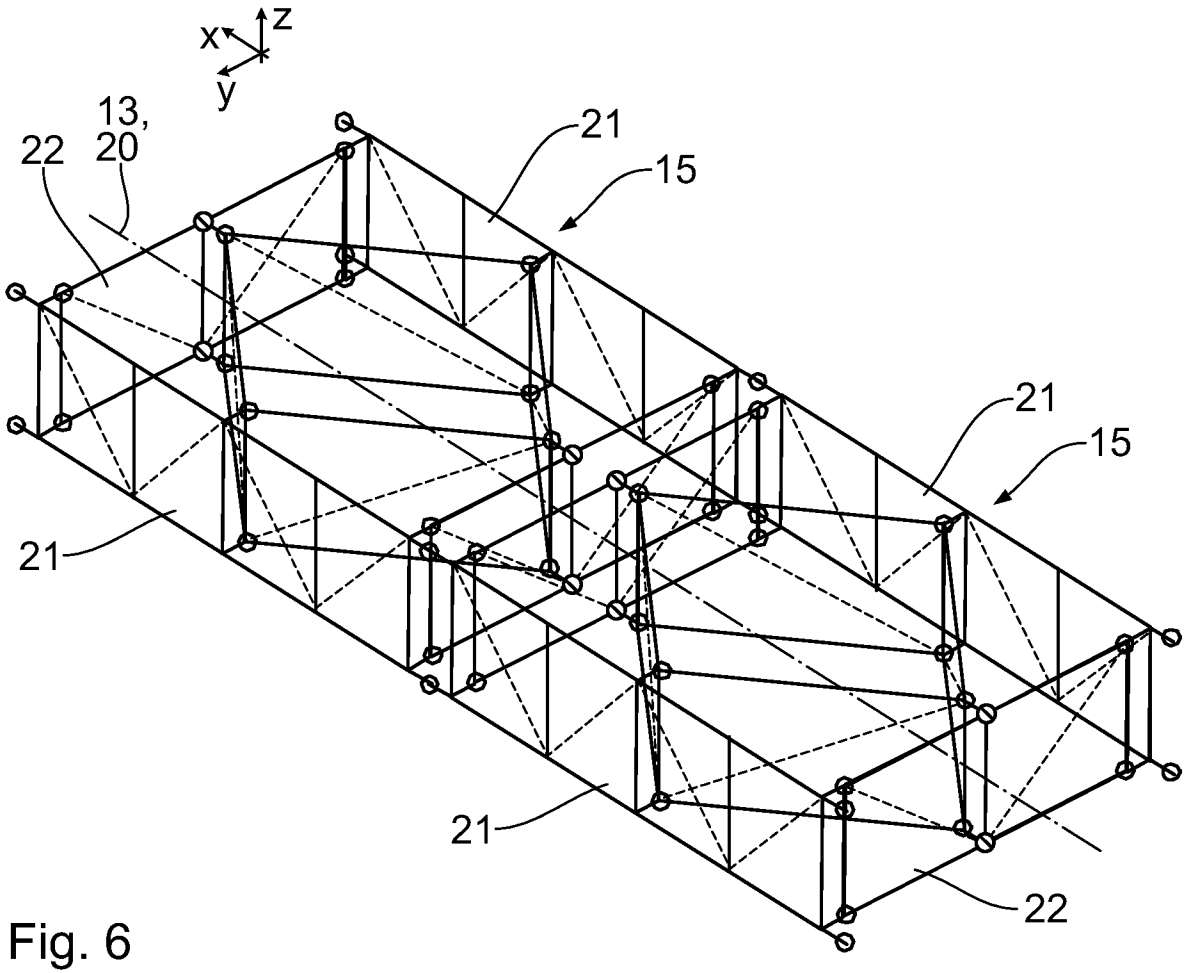
FIG. 6 shows a diagrammatic view of two lattice mast elements according to FIG. 4, the lattice mast elements being arranged one behind the other along a lattice mast element longitudinal axis.

In contrast to the exemplary embodiment according to FIGS. 4, 5, the bracing elements 24 are not configured as two-dimensional load bearing structures. The bracing elements 24 each comprise two individual connection bars 51 oriented parallel to the load bearing surface. In particular because in the illustrated embodiment, the elements are not pivoted relative to each other, it is not necessary for the bracing elements 24 to be configured as two-dimensional load bearing structures. It is in particular not necessary that the bars 51 of the bracing elements 24 are held in a self-supporting manner during a pivoting movement.

In particular, all individual components 50, 51 of the lattice mast element 15 according to FIGS. 40 to 42 are interconnected detachably, in particular using bolts. The space requirement in a transport arrangement can be reduced considerably by removing all detachable connections for the transportation.

According to the actual exemplary embodiment according to FIG. 42, the individual components 50 of the transverse elements 22 are configured as tubular elements having a circular cross-section. Other cross-sectional shapes such as a rectangular or square cross-sectional shape are conceivable as well. The tubular elements are each provided with connection lugs at their ends allowing them to be directly attached to the individual components 50 of the longitudinal elements 21. The individual components 50 of the longitudinal elements 21 are configured as tubular elements as well. The tubular elements of the longitudinal elements each have a rectangular cross-section which corresponds to the illustration shown in FIG. 15. At least one null bar 29 and/or at least one diagonal bar 30 are in each case provided between a respective upper individual component 50 and a lower individual component 50 of the transverse elements 22 and between a respective upper individual component 50 and a lower individual component 50 of the longitudinal elements 21. The null bars 29 and diagonal bars 30 are in each case used to brace the longitudinal elements 21 and transverse elements 22. In other words, the null bars 29 and the diagonal bars 30 ensure a rigid structure of the frame parts of the lattice mast element 15. The lattice mast element 15 itself is braced by the four bracing elements 24. The bracing elements 24 comprise in each case two individual components 51 arranged at a distance from each other in a direction perpendicular to the load bearing surface. The individual components 51 are each connected directly to the individual components 50 of the transverse elements 22 or the longitudinal elements 21 using a bolt. According to the illustrated exemplary embodiment, one bracing element 24 is used at a time to interconnect a longitudinal element 21 with a transverse element 22.

In a lattice mast composed of a plurality of lattice mast elements 15 according to the illustrated exemplary embodiment, the lattice mast elements 15 are arranged one behind the other along the lattice mast element longitudinal axis 20. This means that the intermediate walls formed by the transverse elements 22 are arranged at a distance from each other along the lattice mast element longitudinal axis 20 and perpendicular to the lattice mast element longitudinal axis 20 and in particular parallel to each other. For this purpose, the front ends of the longitudinal elements 21 are each provided with connection lugs 53. The connection lugs 53 extend along the lattice mast element longitudinal axis 20 and allow two adjacent lattice mast elements 15 to be interconnected using a bolt oriented in particular parallel to the transverse elements 22.

The lattice mast element substantially has a frame structure produced by the longitudinal elements 21 and the transverse elements 22. The frame structure has a flat rectangular hollow profile which defines the load bearing surface. A profile element longitudinal axis 54*a* extends perpendicular to the load bearing surface. The profile element longitudinal axis 54*a* is oriented perpendicular to the lattice mast element longitudinal axis 20. In contrast to the approach according to US 2002/0053550 A1 in which the lattice mast element longitudinal axis 20 is arranged identically in relation to the profile element longitudinal axis 54*a*, and in which the upper and lower sides formed by the chords are provided with filler bodies, the lattice mast element according to the invention is configured such that the longitudinal elements 21 have filler bodies in the form of null bars 29 and diagonal bars 30, with corner regions between longitudinal elements 21 and transverse elements 22 being braced by bracing elements 24. In a particularly advantageous embodiment of the chord elements 28 for the longitudinal elements 21 according to FIG. 15, an improved transverse stiffness can be achieved to reduce the number of bracing elements 24 used. Consequently, this means that the profile element longitudinal axis 54*a* is oriented perpendicular to the lattice mast element longitudinal axis 20. Said orientation of the profile element longitudinal axis 54*a* relative to the lattice mast element longitudinal axis 20 applies in particular to all other embodiments of the lattice mast elements according to the invention. Said orientation of the axes 20, 54*a* relative to each other is characteristic of the design of a lattice mast according to the invention.

Figure 43:
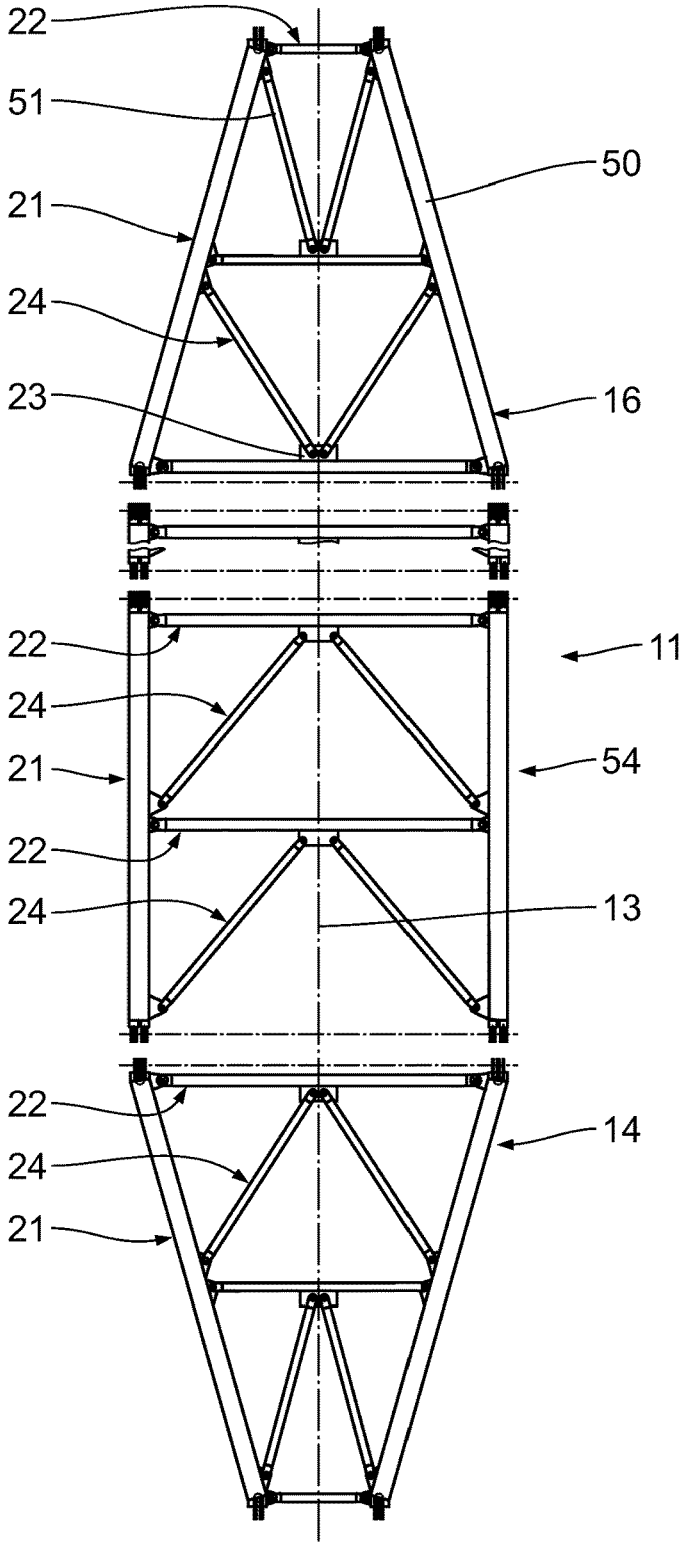
FIG. 43 shows a view, corresponding to FIG. 12, of a lattice boom according to another embodiment.

FIG. 43 shows another embodiment of a lattice boom 11 comprising adapter lattice mast elements 14, 16 and lattice mast elements 54 arranged therebetween. The adapter lattice mast elements 14, 16 substantially correspond to those shown in FIG. 12. The adapter lattice mast elements 14, 16 have a substantially trapezoidal load bearing surface in the drawing plane. The longitudinal elements 21 of the adapter lattice mast elements 14, 16 may have a variable height along the lattice mast longitudinal axis 13. This means that the longitudinal elements 21 of the adapter lattice mast elements 14, 16 are in particular not rectangular but in particular trapezoidal. For instance, a height of the lattice mast elements 54 in a direction perpendicular to the load bearing surface is greater than a height of a head piece and/or foot piece the adapter lattice mast elements 14, 16 are articulated to. The angle of inclination defined by the trapezoidal shape of the longitudinal elements 21 amounts to a few degrees, in particular at most 5°, in particular at most 4°, in particular at most 3°, in particular at most 2°, and in particular at most 1.5°.

Compared to the lattice boom in FIG. 12, the connection elements 23 have a simple design. The connection elements 23 are fastened to the transverse elements 22 configured in one piece along the transverse direction. The connection element 23 is a connection lug fastened to the transverse element 22 in such a way as to form one piece therewith. In this case, the connection element 23 is part of the transverse element 22. The connection element 23 is used to connect the bracing elements 24 to the transverse element 22. The connection elements 23 according to the embodiment in FIG. 43 are not provided to interconnect a plurality of transverse elements. An important reason for this is that the connection elements according to the illustrated exemplary embodiment do not necessarily have a folding function. The illustrated exemplary embodiment of the lattice boom 11 has components that are in each case interconnectable and detachable from each other individually. This means that the individual components 50, 51 of the longitudinal elements 21, the transverse elements 22 and the bracing elements 24 are interconnected detachably, in particular using bolts.

At least one lattice mast element 54 is arranged between the adapter lattice mast elements 14, 16. In particular, a plurality of lattice mast elements 54, for instance at least five, at least ten or more than ten lattice mast elements 54, are arranged between the adapter lattice mast elements 14, 16 along the lattice mast longitudinal axis 13.

Compared to the exemplary embodiment shown in FIG. 12, the arrangement of the lower transverse element 22 of the lattice mast element 54 according to FIG. 43 with the bracing elements 24 articulated thereto is different from the exemplary embodiment shown in FIG. 12. A respective transverse element 22 with the bracing elements 24 articulated thereto has a substantially K-shaped structure. In the lattice mast element 54, the K-shaped structures are arranged one behind the other along the lattice mast longitudinal axis 13 in such a way as to be oriented identically. A lattice mast element 54 of this type has a double K-assembly. In other words, in the lattice mast element 54, two substantially identical K-assemblies are arranged one behind the other along the lattice mast longitudinal axis 13. The lattice mast element 54 has a closed K-assembly arranged at the top of FIG. 43, and an open K-assembly arranged at the bottom of FIG. 43. In other words, the lattice mast element 54 is a double K-assembly that is open on one side. In the closed K-assembly, the transverse element 22 of the lower K-assembly closes an opening of the upper K-assembly. In the lattice mast element 54 with the closed K-assembly comprising two transverse elements 22, the bracing elements 24 are not arranged in the rhombical configuration according to FIG. 12.

Figure 44:
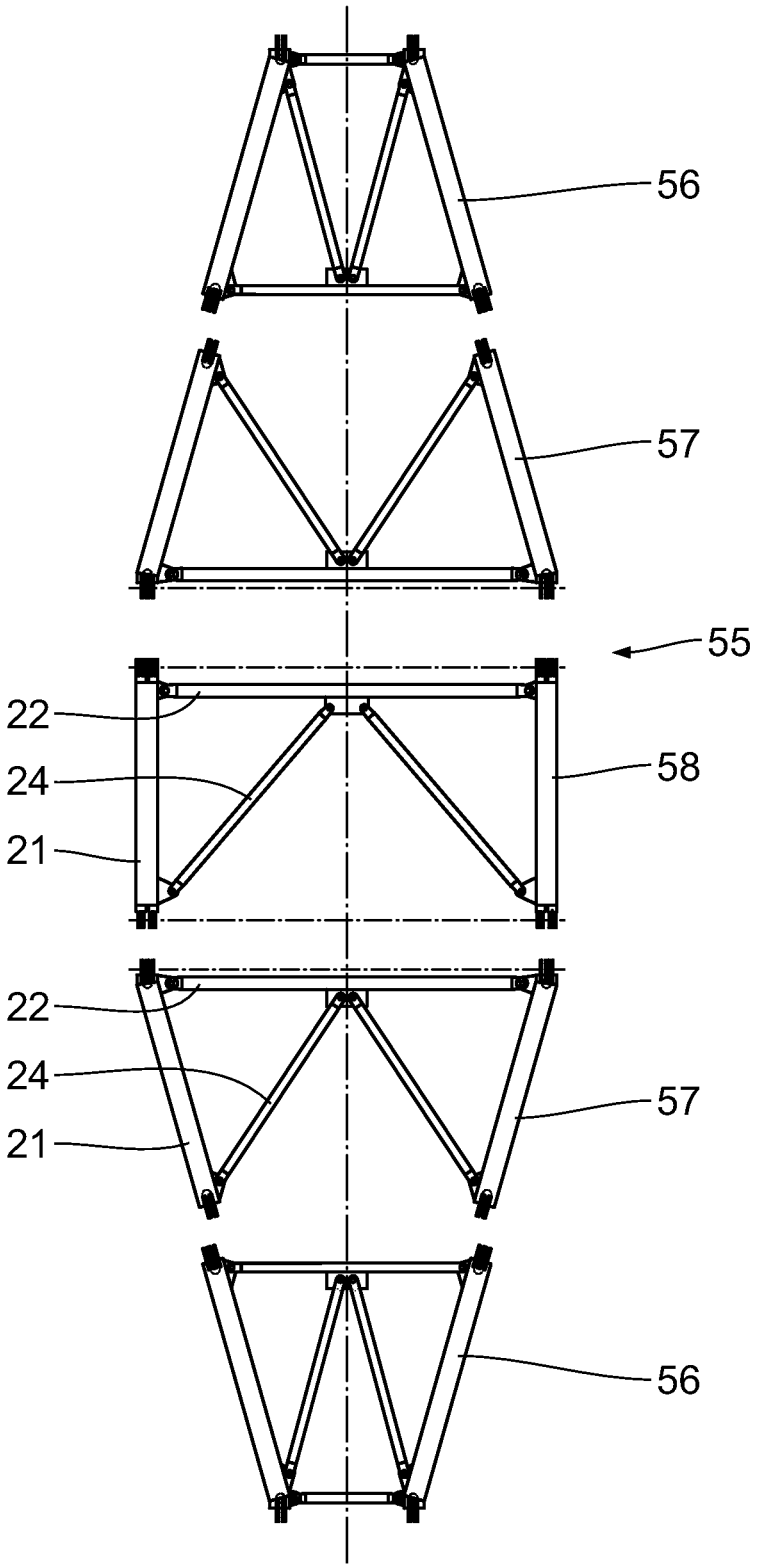
FIG. 44 shows a view, corresponding to FIG. 43, of another embodiment of a lattice boom.

FIG. 44 shows another lattice boom 55. The lattice boom 55 substantially corresponds to the exemplary embodiment shown in FIG. 43. The most important difference is that the individual lattice mast elements are smaller. For instance, the adapter lattice mast elements 14, 16 are configured in two parts in such a way that two adapter lattice mast partial elements 56, 57 are provided that are interconnectable to form the lattice mast element 14 or 16. The respective outer adapter lattice mast partial element 56 provided at an upper end or a lower end is used to mount the lattice boom 55 to a head piece or a foot piece of a crane. The adapter lattice mast partial element 56 is a simple, closed K-assembly forming substantially an outer section of the adapter lattice mast elements 14 or 16. The respective inner adapter lattice mast partial elements 57 are used for attachment to the widened lattice mast element 58. The adapter lattice mast partial elements 57 are each configured as a simple, open K-assembly. The adapter lattice mast partial elements 57 only have one transverse element 22. Each adapter lattice mast partial element 57 has two longitudinal elements 21 interconnected by the transverse element 22. Furthermore, the adapter lattice mast partial element 57 has two bracing elements 24. Each bracing element 24 is arranged between the transverse element 22 and one of the longitudinal elements 21. The bracing elements 24 are used to connect the transverse element 22 directly to in each case one of the longitudinal elements 21.

The adapter lattice mast partial elements 57 are each open in a direction towards the other adapter lattice mast partial element 56. The transverse element 22 facing the respective lattice mast element 58 is provided on a side of the adapter lattice mast partial element 57 opposite to the open side.

The lattice mast elements 58 are each configured as a simple, open K-assembly. The lattice mast elements 58 have two longitudinal elements 21, a transverse element 22 interconnecting the two longitudinal elements and two bracing elements 24. The bracing elements 24 interconnect the transverse element 22 with in each case one of the longitudinal elements 21. The lattice mast element 58 shown in FIG. 44 substantially corresponds to a half of the lattice mast element 54 in FIG. 43. This means in particular that by arranging two lattice mast elements 58 one behind the other, a lattice mast element 54 substantially according to FIG. 43 can be produced. The modularity of the lattice boom 55 according to FIG. 44 is improved. The variability of the components is improved in particular due to the reduced size of the modular elements 56, 57 and 58. The lattice boom 55 may comprise a plurality of lattice mast elements 58 along the lattice mast longitudinal axis 13. In particular the number of the lattice mast elements 58 is variable substantially as required to achieve a desired total length of the lattice boom 55. FIG. 44 shows only one lattice mast element 58 only for reasons of clarity.

Figure 45:
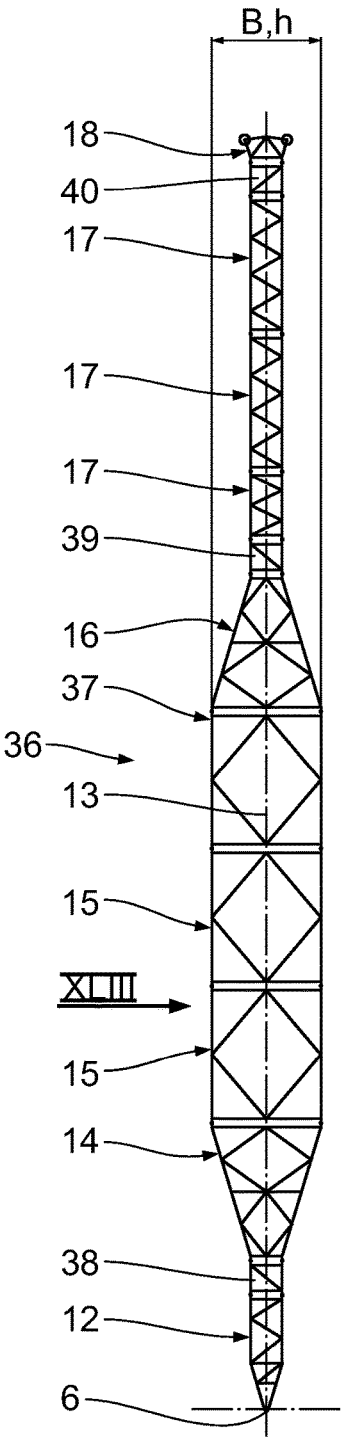
FIG. 45 shows a side view, corresponding to FIG. 2, of a lattice boom according to another embodiment.
Figure 46:
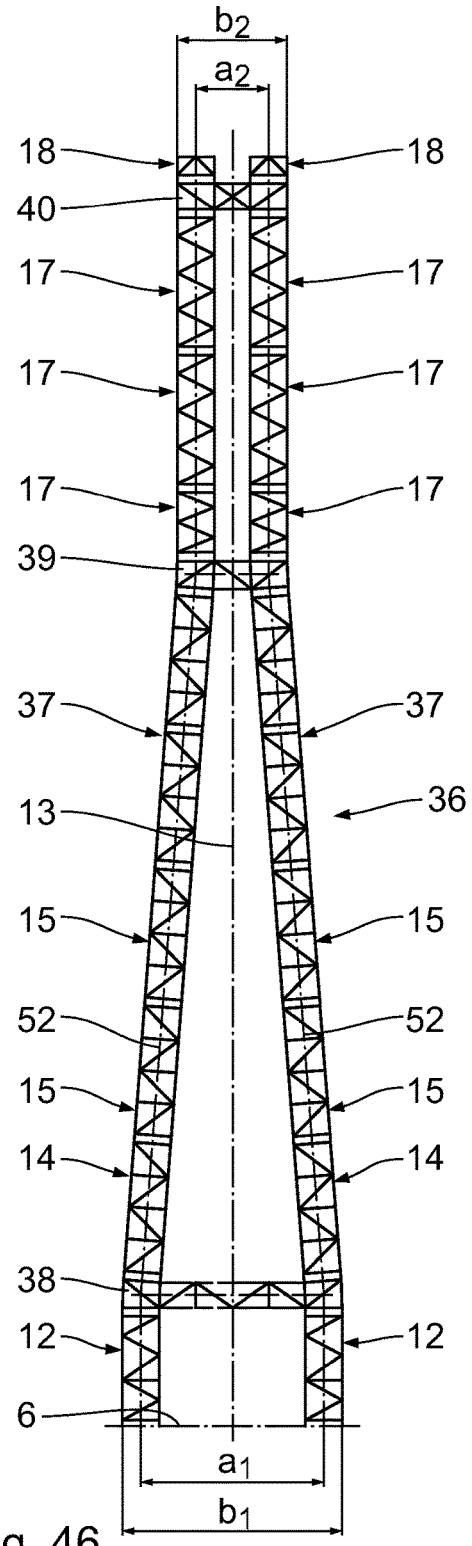
FIG. 46 shows a view according to arrow XLV in FIG. 45.

FIGS. 45 and 46 show another embodiment of a lattice boom 36. Components corresponding to those already explained above with reference to FIGS. 1 to 44 are designated by the same reference numerals and are not discussed in detail again.

The side view of the lattice boom 36 according to FIG. 45 substantially corresponds to the side view according to FIG. 2. The lattice boom 36 has two substantially identical lattice mast element strands 47. The lattice mast element strands 47 are arranged symmetrically in relation to the lattice mast longitudinal axis 13. Compared to the lattice mast elements of the lattice boom 11 in FIGS. 2, 3, the lattice mast elements 15 of a lattice mast element strand 37 are rotated by 90° in relation to the lattice mast longitudinal axis 13. In the lattice boom 36, the lattice mast elements 15 are oriented in such a way that the luffing axis 6 is perpendicular to the load bearing surface. The lattice mast element width B, which—in the lattice boom 36—is oriented perpendicular to the luffing axis 6, corresponds to a lattice mast element strand height that is identical to a lattice mast height h. The individual lattice mast element strands 37 have a lattice mast element strand height that is greater than a lattice mast element strand width. The lattice mast height h is perpendicular to the load bearing surface. The lattice mast height h is perpendicular to a plane spanned by the lattice mast longitudinal axis 13 and the luffing axis 6. The lattice mast element strand width, which corresponds to the lattice mast element height, is parallel to the luffing axis 6. A lattice mast width b oriented parallel to the luffing axis 6 is defined by the lattice mast element strands 37 arranged at a distance from each other. A distance a of the lattice mast element strands 37 is defined by the distance between the two lattice mast element strand longitudinal axes 52, said distance being oriented parallel to the luffing axis 6. In a first region of the lattice boom 36 shown at the bottom of FIG. 46, the lattice mast element strands 37 have a first distance $a_1$. The first lattice mast width $b_1$ resulting therefrom is the sum of the first distance $a_1$ and the lattice mast element strand width. Similarly, this applies accordingly in a second region of the lattice boom 36, shown at the top of FIG. 46, to a second distance $a_2$ and a second lattice mast width $b_2$. In particular, the described relationship applies to the entire lattice boom 36 in general. The lattice mast width b is greater than the lattice mast height h. The lattice mast width b is variable along the lattice mast longitudinal axis 13 at least in sections. This means that the lattice boom 36 has an increased stiffness due to the rotated arrangement of the lattice mast elements 15 and the spaced-apart positioning thereof in a direction oriented perpendicular to the luffing axis 6 and to the lattice mast longitudinal plane 13.

The lattice boom 36 is provided with adapter lattice mast elements 14, 16 adjacent to the lattice mast elements 15. Furthermore, a foot element 12 and a head element 18 as well as additional lattice mast elements 17 having a reduced load bearing surface are provided.

Furthermore, in order to achieve a sufficient load bearing capacity in a plane perpendicular to the drawing plane of FIG. 45, in other words in the drawing plane according to FIG. 46, the lattice boom 36 has a double-strand configuration comprising two substantially identical lattice mast element strands 37. The lattice mast element strands 37 are arranged at a distance from each other relative to the lattice mast longitudinal axis 13. In the region of the foot elements 12, the lattice mast element strands 37 have a maximum distance. The foot elements 12 are arranged parallel to each other. The foot elements 12 are each articulated to the luffing axis 6 in a pivotable manner. At an opposite end, the foot elements 12 are in each case interconnected by means of a cross spreader. The function thereof is to brace the lattice boom 36 for interconnecting the lattice mast element strands 37. The cross spreader 38 is in particular made of lattice mast elements. The cross spreader 38 is adjoined along the lattice mast longitudinal axis 13 by the adapter lattice mast elements 14, the lattice mast elements 15 and the adapter lattice mast elements 16. Above the adapter lattice mast elements 16, another cross spreader 39 is provided to interconnect the two lattice mast element strands 37. Between the two cross spreaders 38, 39, the lattice mast element strands 37 are arranged at an angle in relation to the lattice mast longitudinal axis 13. The lattice boom 36 is substantially configured in the shape of the letter A. In a region above the cross spreader 39, the lattice mast elements 17 are parallel to the lattice mast longitudinal axis 13. Between the lattice mast elements 17 and the head elements 18, another cross spreader 40 is provided to further brace the lattice boom 36.

The invention claimed is:

1. A crane comprising an undercarriage, crawler running gears arranged parallel to each other on an underside of the undercarriage, a superstructure arranged on an upper side of the undercarriage, a lattice boom connected to the superstructure and articulated with respect to a horizontal luffing axis, the lattice boom comprising at least one lattice mast element, wherein the at least one lattice mast element comprises a. at least two longitudinal elements, b. a transverse element interconnecting the longitudinal elements, and c. at least four bracing elements for bracing the at least one lattice mast element by interconnecting at least one of the longitudinal elements with the transverse element and which are arranged parallel to a load bearing surface, which is arranged parallel to a lattice mast element longitudinal axis, wherein d. the longitudinal elements and the transverse element define the load bearing surface of the lattice mast element, and e. the longitudinal elements, the transverse element and the bracing elements are each configured as a two-dimensional load bearing structure, wherein the at least four bracing elements interconnect the longitudinal elements with the transverse element to brace a corner region between the longitudinal elements and the transverse element, and wherein the at least four bracing elements are arranged in a rhombical shape.

2. The crane according to claim 1, wherein the at least one lattice mast element comprising a lattice mast element width B greater than a lattice mast element height H oriented perpendicular to the load bearing surface.

3. The crane according to claim 2, wherein $B>2\cdot H$.

4. The crane according to claim 2, wherein $B>3\cdot H$.

5. The crane according to claim 2, wherein $B>4\cdot H$.

6. The crane according to claim 2, wherein the lattice mast element width B is adjustable between a minimum lattice mast element width and a maximum lattice mast element width by a variable arrangement of the longitudinal elements relative to each other.

7. The crane according to claim 1, wherein the longitudinal elements are configured as one of a truss, a frame or a girder.

8. The crane according to claim 1, wherein at least one of the longitudinal elements or the transverse elements each have two chord elements arranged at a distance from each other along a height.

9. The crane according to claim 8, wherein the axial geometrical moment of inertia of the two chord elements about a z-axis is greater than the axial geometrical moment of inertia thereof about a y-axis oriented perpendicular to the z-axis.

10. The crane according to claim 1, wherein the transverse element comprises at least two transverse elements which, in a working arrangement of the lattice mast element, are interconnected so as to be unable to rotate about a z-axis oriented perpendicular to the load bearing surface and which, in a transport arrangement of the lattice mast element, are interconnected about a z-axis oriented perpendicular to the load bearing surface in an articulated manner.

11. The crane according to claim 10, comprising in each case one connection element interconnecting the transverse elements.

12. The crane according to claim 1, comprising a bearing surface in the shape of a rectangle or a trapezoid.

13. The crane according to claim 1, comprising at least one drive element for the driven displacement of the lattice mast element from a working arrangement into a transport arrangement and vice versa.

14. The crane according to claim 1, wherein the longitudinal elements are each made of multiple parts.

15. The crane according to claim 14, wherein the transverse elements are each made of multiple parts.

16. The crane according to claim 14, wherein at least one of the longitudinal elements or the transverse elements comprises a plurality of individual components which are interconnectable detachably.

17. The crane according to claim 16, wherein the individual components are interconnectable using bolts.

* * * * *